US011443933B1

(12) United States Patent
Yamada

(10) Patent No.: US 11,443,933 B1
(45) Date of Patent: Sep. 13, 2022

(54) INDUCTIVELY COUPLED PLASMA MASS SPECTROMETRY (ICP-MS) WITH ION TRAPPING

(71) Applicant: Agilent Technologies, Inc., Santa Clara, CA (US)

(72) Inventor: Noriyuki Yamada, Tokyo (JP)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 17/102,313

(22) Filed: Nov. 23, 2020

Related U.S. Application Data

(63) Continuation of application No. 17/086,135, filed on Oct. 30, 2020, now abandoned.

(51) Int. Cl.

| | |
|---|---|
| ***H01J 49/10*** | (2006.01) |
| ***H01J 49/02*** | (2006.01) |
| ***H01J 49/06*** | (2006.01) |
| ***H01J 49/00*** | (2006.01) |
| *H01J 49/04* | (2006.01) |

(52) U.S. Cl.
CPC ..... *H01J 49/105* (2013.01); *H01J 49/004* (2013.01); *H01J 49/022* (2013.01); *H01J 49/063* (2013.01); *H01J 49/0459* (2013.01)

(58) Field of Classification Search
CPC ..... H01J 49/022; H01J 49/004; H01J 49/105; H01J 49/4225
See application file for complete search history.

(56) References Cited

U.S. PATENT DOCUMENTS

| | | | |
|---|---|---|---|
| 5,672,870 | A | 9/1997 | Flory et al. |
| 5,847,386 | A | 12/1998 | Thomson et al. |
| 6,111,250 | A | 8/2000 | Thomson et al. |
| 6,140,638 | A | 10/2000 | Tanner et al. |
| 6,177,668 | B1 | 1/2001 | Hager |
| 6,265,717 | B1 | 7/2001 | Sakata et al. |
| 6,875,618 | B2 | 4/2005 | Bandura et al. |
| 7,671,329 | B2 | 3/2010 | Sakata et al. |

(Continued)

FOREIGN PATENT DOCUMENTS

| | | | | |
|---|---|---|---|---|
| WO | WO-2013098599 A1 * | 7/2013 | ..... | H01J 49/0045 |
| WO | WO-2015097504 A1 * | 7/2015 | ..... | H01J 49/4205 |

OTHER PUBLICATIONS

Agilent 7800 Quadrupole ICP-MS. ORS and Helium Mode for More Effective Interference Removal in Complex Samples. Jun. 2015.

(Continued)

*Primary Examiner* — David E Smith

(57) ABSTRACT

An inductively coupled plasma-mass spectrometry (ICP-MS) system includes an ion trap, in which ions are trapped and subsequent ejected by mass-selective ejection (MSE). The system may have a linear quadrupole configuration, in which the ion trap is a linear ion trap (LIT) that is preceded by a pre-LIT linear quadrupole device and/or a post-LIT quadrupole device. The pre-LIT and/or post-LIT quadrupole device may be configured or operated as an RF-only ion guide or as a mass filter or mass analyzer, with or without mass scanning. The system may be utilized in particular for multi-element analysis of fast transient signals produced from ion pulses, where the sample under analysis is a single particle, single biological cell, or a cloud or aerosol produced for example by single-shot laser ablation.

19 Claims, 13 Drawing Sheets

(56) References Cited

U.S. PATENT DOCUMENTS

| | | | | |
|---|---|---|---|---|
| 7,872,227 | B2 | 1/2011 | Yamada et al. | |
| 8,481,925 | B2 | 7/2013 | Antonov et al. | |
| 8,610,053 | B2 | 12/2013 | Yamada et al. | |
| 9,952,134 | B2 | 4/2018 | Bandura et al. | |
| 2004/0011956 | A1* | 1/2004 | Londry | H01J 49/4225 250/292 |
| 2007/0084998 | A1 | 4/2007 | Franzen et al. | |
| 2011/0284734 | A1* | 11/2011 | Hoyes | G01N 27/622 250/282 |
| 2011/0284741 | A1 | 11/2011 | Stoermer et al. | |
| 2012/0119078 | A1 | 5/2012 | Green et al. | |
| 2012/0248301 | A1 | 10/2012 | Short et al. | |
| 2016/0056031 | A1* | 2/2016 | Loboda | G01N 15/1404 250/288 |
| 2017/0084447 | A1 | 3/2017 | Rottmann et al. | |
| 2018/0254176 | A1* | 9/2018 | Tanner | H04L 1/1664 |
| 2020/0027714 | A1* | 1/2020 | Jiang | H01J 49/426 |
| 2020/0051800 | A1* | 2/2020 | McAlister | H01J 49/0072 |

OTHER PUBLICATIONS

Agilent 8900 Triple Quadrupole ICP-MS. Leave Interferences Behind with MS/MS. Jun. 2016.

Agilent ICP-MS Journal, McCurdy, Ed. The Benefits of Ms/MS for Reactive Cell Gas Methods in ICP-MS 5991-8559EN. Oct. 2017—Issue 70 (eight (8) pages).

Amr, Mohamed A. "The collision/reaction cell and its application in inductively coupled plasma mass spectrometry for the determination of radioisotopes: A literature review." Advances in Applied Science Research, 2012, 3 (4):2179-2191.

Beaugrand, Claude. Ion Confinement in the Collision Cell of a Multiquadrupole Mass Spectrometer: Access to Chemical Equilibrium and Determination of Kinetic and Thermodynamix Parameters of an Ion-Molecule Reaction. Anal. Chern. 1989, 61, 1447-1453.

CAP Rq ICP-MS Pre-Installation Requirements Guide. Revision A. Nov. 2016. ThermoFisher Scientific.

Dolnikowski, G.G. et al. Ion-Trapping Technique for Ion/Molecule Reaction Studies in the Center Quadrupole of a Triple Quadrupole Mass Spectrometer. International Journal of Mass Spectrometry and Ion Processes, 82 (1988) 1-15.

Gundlach-Graham et al., Toward faster and higher resolution LA-ICPMS imaging: on the co-evolution of LA cell design and ICPMS instrumentation, Anal. Bioanal. Chem., 408, p. 2687-2695 (2016).

Guo, Wei, et al. "Application of ion molecule reaction to eliminate WO interference on mercury determination in soil and sediment samples by ICP-MS." J. Anal. At. Spectrom., 2011, 26, 1198.

Ho et al., Time-resolved ICP-MS measurement for single-cell analysis and on-line cytometry, J. Anal. At. Spectrom., 25, p. 1114-1122 (2010).

Laborda et al., Single Particle Inductively Coupled Plasma Mass Spectrometry: A Powerful Tool for Nanoanalysis, Anal. Chem., 86, p. 2270-2278 (2014).

Preparing Your Lab. ICP—Mass Spectrometry. Copyright 2017-2018.

Qiao et al., Space-charge effect with mass-selective axial ejection from a linear quadrupole ion trap, Rapid Commun. Mass Spectrom., 25, p. 3509-3520 (2011).

Quarles, C. Derrick, Jr., et al. "Analytical method for total chromium and nickel in urine using an inductively coupled plasma-universal cell technology-mass spectrometer (ICP-USCT-MS) in kinetic energy discrimination (KED) mode." (J. Anal. At. Spectrom., 2014, 29, 297.

Standard Operation Procedure for Trace Element Analysis of Flue Gas Desulfurization Wastewaters Using ICP-MS Collision/Reaction Cell Procedure. US Environmental Protection Agency. Mar. 2013 (thirty-two (32) pages).

Tanner, Scott D., et al. "Reaction cells and collision cells for ICP-MS: a tutorial review." Spectrochimica Acta Par B 57 (2002). 1361-1452.

Wolf, Ruth E. What is ICP-MS?. . . and more importantly, what can it do? USGS/CR/CICT, Mar. 2005 (seven (7) pages).

* cited by examiner

INDUCTIVELY COUPLED PLASMA MASS SPECTROMETRY (ICP-MS) WITH ION TRAPPING

RELATED APPLICATIONS

The present application is a continuation application under 37 C.F.R. § 1.53(b) of commonly owned U.S. patent application Ser. No. 17/086,135, filed on Oct. 30, 2020, the contents of which are incorporated by reference herein in its entirety.

TECHNICAL FIELD

The present invention relates generally to inductively coupled plasma-mass spectrometry (ICP-MS), and particularly to ICP-MS utilizing an ion trap, including for multi-element analysis of fast transient signals produced from ion pulses.

BACKGROUND

Inductively coupled plasma-mass spectrometry (ICP-MS) is often utilized for elemental analysis of a sample, such as to measure the concentration of trace metals in the sample. An ICP-MS system includes a plasma-based ion source to generate plasma to break molecules of the sample down to atoms and then ionize the atoms in preparation for the elemental analysis. In a typical operation, a liquid sample is nebulized, i.e., converted to an aerosol (a fine spray or mist), by a nebulizer (typically of the pneumatic assisted type) and the aerosolized sample is directed into a plasma plume generated by a plasma source. The plasma source often is configured as a flow-through plasma torch having two or more concentric tubes. Typically, a plasma-forming gas such as argon flows through an outer tube of the torch and is energized into a plasma by an appropriate energy source (typically a radio frequency (RF) powered load coil). The aerosolized sample flows through a coaxial central tube (or capillary) of the torch and is emitted into the as-generated plasma. Exposure to plasma breaks the sample molecules down to atoms, or alternatively partially breaks the sample molecules into molecular fragments, and ionizes the atoms or molecular fragments.

The resulting analyte ions, which are typically positively charged, are extracted from the plasma source and directed as an ion beam into a mass analyzer. The mass analyzer applies a time-varying electrical field, or a combination of electrical and magnetic fields, to spectrally resolve ions of differing masses on the basis of their mass-to-charge (m/z) ratios, enabling an ion detector to then count each type of ion of a given m/z ratio arriving at the ion detector from the mass analyzer. Alternatively the mass analyzer may be a time of flight (TOF) analyzer, which measures the times of flight of ions drifting through a flight tube, from which m/z ratios may then be derived. The ICP-MS system then presents the data so acquired as a spectrum of mass (m/z ratio) peaks. The intensity of each peak is indicative of the concentration (abundance) of the corresponding element of the sample.

In addition to conventional elemental analysis, ICP-MS has come into use for characterization of small particles and biological cells as one of the techniques to measure their size, number density and elemental composition. These techniques are known as single particle ICP-MS (sp-ICP-MS) and single cell ICP-MS (sc-ICP-MS), respectively, also referred to herein collectively as sp(sc) ICP-MS. Coupled with a laser ablation (LA) system, ICP-MS is also utilized for elemental imaging of solid samples such as rocks and biological tissues, which is known as laser ablation ICP-MS (LA-ICP-MS) imaging High-quality elemental images can be obtained from the spot-resolved imaging, where a cloud of ablated aerosol produced by one shot of a laser pulse irradiated on a spot of sample material is analyzed to make one pixel. In sp(sc) ICP-MS and LA spot-resolved imaging, particles, cells, or clouds of aerosol are delivered to the ICP ionization device (ICP torch) one by one, thereby resulting in narrow ion pulses and consequently corresponding short transient signals that are to be mass-analyzed by the ICP-MS system.

Since its first marriage with a quadrupole mass filter, ICP has been coupled with various types of mass spectrometers as noted above. Despite its drawbacks, quadrupole ICP-MS (ICP-QMS) remains the most common instrument type because of its robustness, ease of use and low cost relative to other instrument types, with the primary alternatives being sector field MS (SF-MS) and time-of-fight MS (TOF-MS). However, as a scanning-type mass spectrometer, the quadrupole is not suitable for multi-element analysis of fast transient signals such as those encountered in sp(sc) ICP-MS, or LA ICP-MS imaging with a low-dispersion LA cell. For example, the ion signal generated from a nanoparticle or a biological cell has typically a sub-millisecond duration. The ion signal generated from a single shot of laser in LA-ICP-MS imaging with a state-of-the art low-dispersion LA cell is shorter than ten milliseconds. From such short transient signals, quantitative measurement of multiple elements is virtually impossible by the scanning quadrupole, which takes sub-milliseconds to a few milliseconds, including a settling time, to measure even only two elements jumping from one mass to another. Quantitative detection of multiple elements in such a short period has only been possible with the mass spectrometers having a (quasi-) simultaneous detection capability, such as multi-collector sector field MS (MC-SF-MS) (i.e., utilized a multi-collector ion detector configuration) and TOF-MS. Although ICP-QMS is popular in sp(sc) ICP-MS, only one isotope of an element is usually measured for individual particles, which is done without scanning the quadruple mass filter through a mass range of the ions contained therein. As a result, thus far ICP-MC-SF-MS or ICP-TOF-MS has been exclusively utilized to measure the elemental composition of a single particle or the relative abundances of the elements contained in a single cell or a single pixel (that is, in order to obtain multi-element information from each particle or each pixel).

Therefore, there continues to be a need for improved ICP-MS systems and methods, including for multi-element analysis of brief (fast) transient signals produced from ion pulses.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a method for multi-element analysis by inductively coupled plasma-mass spectrometry (ICP-MS), the method includes: ionizing a sample by ICP ionization to produce an ion pulse comprising a plurality of ions having two or more different masses; injecting the ion pulse into an ion trap; after the injecting, confining the ions of the injected ion pulse in the ion trap during a confinement period, during which the confining prevents the confined ions from exiting the ion trap and prevents other ions outside of the ion trap from entering the ion trap; after the confinement period, ejecting ions of selected masses of the confined ions successively from the ion trap by mass-selective ejection; and transmitting the ejected ions successively to an ion detector for measurement.

According to another embodiment, an inductively coupled plasma-mass spectrometry (ICP-MS) system includes: an ion source configured to receive successive single samples, generate plasma, and produce respective ion pulses in the plasma from the successive single samples, respectively; an ion trap; an ion detector; and a controller comprising an electronic processor and a memory, and configured to control an operation comprising:

producing an ion pulse in the ion source comprising a plurality of ions having two or more different masses; injecting the ion pulse into the ion trap; after the injecting, confining the ions of the injected ion pulse in the ion trap during a confinement period, during which the confining prevents the confined ions from exiting the ion trap and prevents other ions outside of the ion trap from entering the ion trap; after the confinement period, ejecting ions of selected masses of the confined ions successively from the ion trap by mass-selective ejection; and transmitting the ejected ions successively to the ion detector for measurement.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
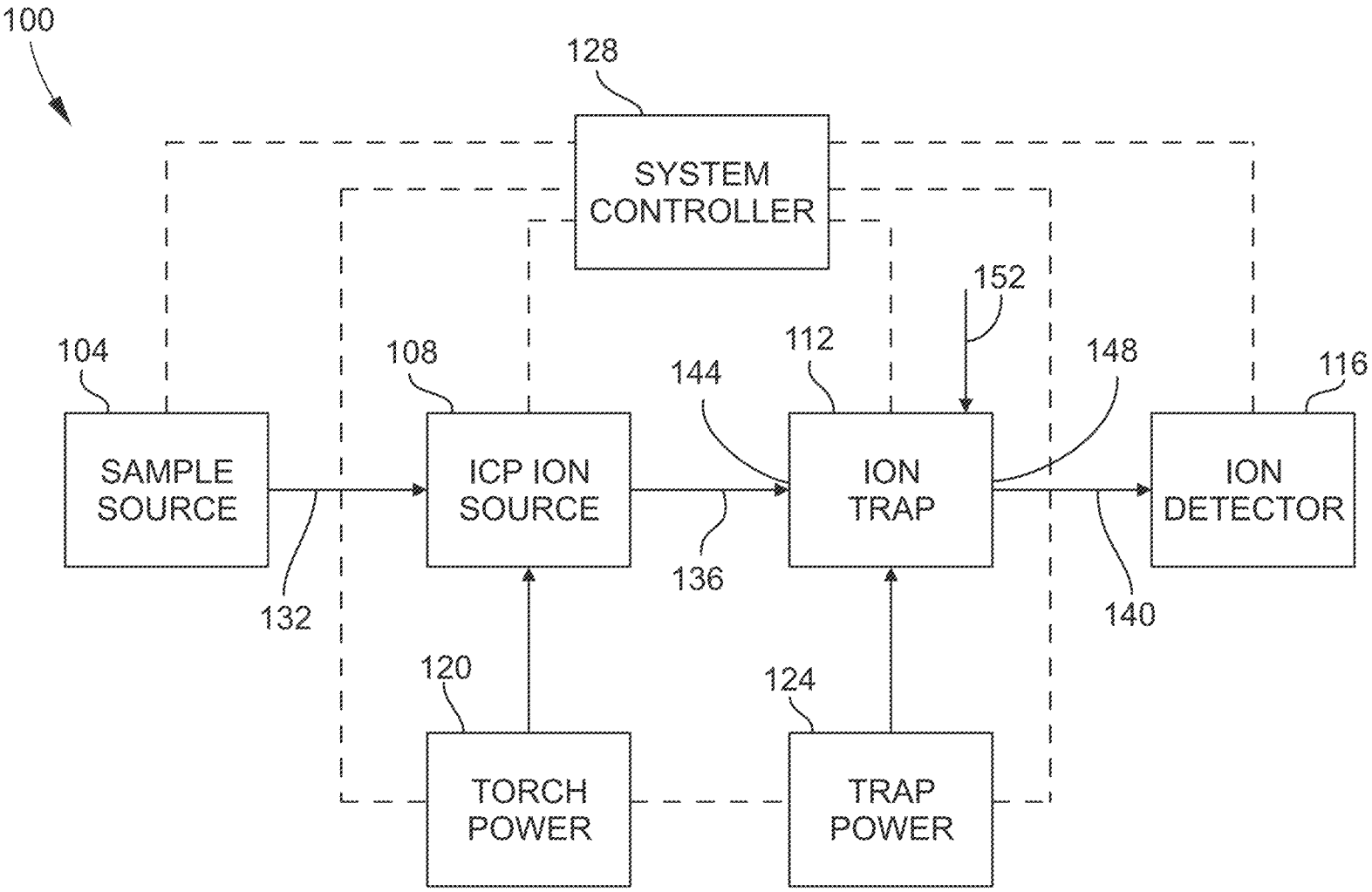
FIG. 1 is a schematic view of an example of an inductively coupled plasma-mass spectrometry (ICP-MS) system according to an embodiment of the present disclosure.

As used herein, the term "fluid" is used in a general sense to refer to any material that is flowable through a conduit. Thus, the term "fluid" may generally refer to either a liquid or a gas, unless specified otherwise or the context dictates otherwise.

As used herein, the term "liquid" may generally refer to a solution, a suspension, or an emulsion. Solid particles and/or gas bubbles may be present in the liquid.

As used herein, the term "aerosol" generally refers to an assembly of liquid droplets and/or solid particles suspended in a gaseous medium. The size of aerosol droplets or particles is typically on the order of micrometers (μm). See Kulkarni et al., Aerosol Measurement, 3rd ed., John Wiley & Sons, Inc. (2011), p. 821. An aerosol may thus be considered as comprising liquid droplets and/or solid particles and a gas that entrains or carries the liquid droplets and/or solid particles.

As used herein, the term "atomization" refers to the process of breaking molecules or solid particles down to atoms. Atomization may be carried out, for example, in a plasma enhanced environment. In the case of a liquid sample, "atomizing" may entail nebulizing the liquid sample to form an aerosol, followed by exposing the aerosol to plasma or to heat from the plasma.

As used herein, a "liquid sample" includes one or more different types of analytes of interest dissolved or otherwise carried in a liquid matrix. The liquid matrix includes matrix components. Examples of "matrix components" include, but are not limited to, water and/or other solvents, acids, soluble materials such as salts and/or dissolved solids, undissolved solids or particulates, and any other compounds that are not of analytical interest.

For convenience in the present disclosure, unless specified otherwise or the context dictates otherwise, a "reaction gas" or "reactive gas" refers to gas or mixture of different gases utilized to react with analyte ions or interfering ions in an ion trap.

As used herein, the term "analyte ion" generally refers to any ion produced by ionizing a component of a sample being analyzed by an inductively coupled plasma-mass spectrometry (ICP-MS) system, for which mass spectral data is sought. Examples of analyte ions are noted herein.

As used herein, the term "interfering ion" generally refers to any ion present in a mass spectrometry system that interferes with an analyte ion, in particular with the analysis of an analyte ion, and more particularly with the mass spectral analysis of an analyte ion. Examples of interfering ions are noted herein.

Despite the drawbacks of employing a quadrupole device for multi-element analysis of samples, a quadrupole device is, relative to alternative devices, free of difficulties of operation, high cost and low dynamic range often unsuitable for conventional elemental analysis. Embodiments disclosed herein provide ICP-QMS systems and methods capable of multi-element analysis of transient signals, consequently rendering quadrupole-based systems more useful and desirable for analytical atomic spectrometry. Embodiments disclosed herein incorporate an ion trap, particularly a linear ion trap (LIT), into an ICP-QMS system. The LIT (or other type of ion trap) is able to trap (i.e., confine or store for a desired period of time) a single ion pulse generated from a single particle, (biological) cell, or aerosol cloud (e.g., generated from ablation of a solid material by a single shot of laser, or laser pulse). Accordingly, such embodiments enable mass analysis of the ions trapped by the LIT (or other type of ion trap) to thereby provide multi-element information of the particle or the pixel under analysis.

FIG. 1 is a schematic view of an example of an inductively coupled plasma-mass spectrometry (ICP-MS) system 100 according to an embodiment. Generally, the structures and operations of various components of ICP-MS systems are known to persons skilled in the art, and accordingly are described only briefly herein as necessary for understanding the subject matter being disclosed.

In the present illustrative embodiment, the ICP-MS system 100 generally includes, in order of workflow, a sample introduction section or system (or sample source) 104, an ICP ion source 108, an ion trap 112, and an ion detector 116. The ICP-MS system 100 also includes an ion source (e.g. ICP torch) power supply 120 configured to supply appropriate electrical power to one or more components of the ion source 108, and an ion trap power supply 124 configured to supply appropriate electrical power to one or more components of the ion trap 112. The ICP-MS system 100 also includes a vacuum system (not shown) configured to exhaust gases from, and create and maintain desired internal pressures or vacuum levels in, various internal regions of the ICP-MS system 100. For example, the vacuum system is configured to remove gases derived from the ICP ion source 108, and create and maintain a certain sub-atmospheric or vacuum-level pressure inside the ion trap 112 as well as in other ion guiding or processing devices that may be provided in the ICP-MS system 100. For these purposes, the vacuum system includes appropriate pumps and gas conduits (e.g., tubes, pipes, passages, chambers, etc.) communicating with ports of the internal regions to be exhausted or evacuated. The ICP-MS system 100 also includes a system controller 128 in signal communication with one or more of the foregoing components of the ICP-MS system 100 for various purposes. For example, the system controller 128 may be configured to control and coordinate the operations of such components, and receive and process the ion measurement signals produced by (or outputted from) the ion detector 116 during operation to produce user-interpretable data relating to the sample under analysis.

Generally, the sample introduction system 104 constitutes an assembly of components configured to introduce (supply) single (or individual) samples serially or sequentially (one by one) to the ICP ion source 108. In the present context, a "single" (or "individual") sample refers to a single particle (e.g., nanoparticle), a single biological cell, or a single aerosol cloud. An aerosol cloud typically is generated by a transient event such as a laser shot or pulse that ablates a solid sample material to which the laser shot or pulse is directed. More generally, a single sample is one from which a single ion pulse (or burst, or packet) is produced by the ICP ion source 108 and, in turn, a transient ion measurement signal is produced by the ion detector 116. The single samples may be discrete portions of a larger quantity of sample material provided. The flow or transport of a single sample, or two or more single samples in succession, as outputted by the sample introduction system 104 and directed into the ICP ion source 108, is depicted by an arrow 132 in FIG. 1.

The sample introduction system 104 may include, for example, a sample source for providing the sample material to be analyzed (e.g., one or more vials, which may be selected by an automated device), a pump or other device (e.g., a pressurized reservoir) for establishing a pressure differential and thereby a flow of the individual samples successively into the ICP ion source 108 via a sample supply conduit, a nebulizer for converting a liquid sample into an aerosol, and a spray chamber for removing larger droplets from the aerosolized sample. The nebulizer may, for example, utilize a flow of argon or other inert gas (nebulizing gas) from a gas source (e.g., a pressurized reservoir) to aerosolize the sample. The nebulizing gas may be the same gas as the plasma-forming gas utilized to create plasma in the ICP ion source 108, or may be a different gas. The sample source may also include one or more vials for containing various standard solutions, a tuning liquid, a calibration liquid, a rinse liquid, etc. For further reference in the context of single-cell analysis, see Ho et al., Time-resolved ICP-MS measurement for single-cell analysis and on-line cytometry, *J. Anal. At. Spectrom.,* 25, p. 1114-1122 (2010), the contents of which are incorporated by reference herein. In one embodiment, a monodisperse droplet generator may be utilized, as appreciated by persons skilled in the art. See, for example, Laborda et al., Single Particle Inductively Coupled Plasma Mass Spectrometry: A Powerful Tool for Nanoanalysis, *Anal. Chem.,* 86, p. 2270-2278 (2014), the contents of which are incorporated by reference herein. One example of a single-particle injector configured to introduce particles or cells sequentially to an ICP ion source is described in U.S. Pat. No. 9,952,134, the contents of which are incorporated by reference herein. When creating an aerosol cloud of an ablated sample material as the sample for introduction into the ICP ion source 108, the sample introduction system 104 may include a laser ablation cell, as appreciated by persons skilled in the art. As a non-exclusive example, a solid sample may be placed in a laser ablation cell (i.e., a chamber) and the cell filled with an inert carrier gas. A pulsed laser beam is then utilized to ablate a small quantity of the material from the solid sample surface. The resulting aerosol containing the sample material is then flowed with the carrier gas to the sample inlet of the ICP ion source 108. For further reference, see Gundlach-Graham et al., Toward faster and higher resolution LA-ICPMS imaging: on the co-evolution of LA cell design and ICPMS instrumentation, *Anal. Bioanal. Chem.,* 408, p. 2687-2695 (2016), the contents of which are incorporated by reference herein.

The ICP ion source 108 includes a plasma source for atomizing and ionizing each single sample received from the sample introduction system 104. In a typical embodiment, the plasma source is a flow-through ICP torch. The ICP torch may include a central tube serving as a sample injector, and one or more outer tubes (e.g., an intermediate tube and an outermost tube) concentrically arranged about the sample injector. The sample injector and other tubes of the ICP torch may be constructed from, for example, quartz, borosilicate glass, or a ceramic. The sample injector alternatively may be constructed from a metal such as, for example, platinum. The ICP torch is located in an ionization chamber, or "torch box." A work coil (also termed a load coil or RF coil) is coupled to the ion source power supply 120, which is typically a radio frequency (RF) power source, and is positioned at the discharge end of the ICP torch.

In operation, a plasma-forming (or plasma precursor) gas such as argon is flowed to one of the tubes surrounding the sample injector. Radio-frequency (RF) power is applied to the work coil by the ion source power supply 120 while the plasma-forming gas flows through the ICP torch, thereby generating a high-frequency, high-energy electromagnetic field to which the plasma-forming gas is exposed. The work coil is operated at a frequency and power effective for generating and maintaining plasma from the plasma-forming gas. A spark may be utilized to provide seed electrons for initially striking the plasma-forming gas to trigger the formation of plasma. Consequently, a plasma plume is formed in the torch box. The sample flows through the sample injector and is emitted from the sample injector and injected into the active plasma. As the sample flows through the heating zones of the ICP torch and eventually interacts with the plasma, the sample undergoes drying, vaporization, atomization, and ionization, whereby analyte ions are produced from components (particularly atoms) of the sample, according to principles appreciated by persons skilled in the art.

The ions produced in the ICP ion source 108 are then transported into the ion trap 112, as depicted by an arrow 136. The sample introduction system 104 and the ICP ion source 108 are configured for a single-sample (e.g., single-particle, single-cell, or single aerosol cloud) mode of operation. That is, in concert with the sample introduction system 104, the ICP ion source 108 produces an ion pulse (or ion burst, ion packet, etc.), and the ion pulse is transferred into the ion trap 112. In addition to the analyte ions produced from the sample material, the ion pulse may also include interfering ions, i.e., ions that interfere with the analysis of one or more of the analyte ions, as appreciated by persons skilled in the art. Examples of interfering ions include, but are not limited to, positive argon ions (i.e., plasma ions created from ionization of argon gas utilized as the plasma-forming gas), polyatomic ions containing argon doubly-charged ions containing a component of the sample, isobaric ions containing a component of the sample (i.e., isobaric with respect to certain analyte ions created from ionization of the sample), and polyatomic ions containing a component of the sample. Here, the "component" of the sample may be an analyte element or a non-analyte species such as may be derived from the matrix components of the sample or other background species.

The ICP-MS system 100 may include additional, intermediate components (not shown) positioned between the ICP ion source 108, which typically operates at or around atmospheric pressure (760 Torr), and the ion trap 112 that are configured to facilitate the transport of the ion pulse from the ICP ion source 108 to the ion trap 112. For example, an interface section may provide a first stage of pressure reduction between the ICP ion source 108 and the lower-pressure ion trap 112 and other evacuated regions of the ICP-MS system 100. For example, the interface section may be maintained at an operating vacuum of for example around 1-2 Torr by a mechanical roughing pump (e.g., a rotary pump, scroll pump, etc.), while the ion trap 112 may be maintained at an operating pressure of for example around $10^{-2}$ Torr by a high-vacuum pump (e.g., a turbomolecular pump, etc.). Neutral gas molecules entering the interface section may be exhausted from the ICP-MS system 100 via a vacuum port. An ion optics section may be provided in a second stage of pressure reduction upstream of the ion trap 112. The ion optics section may include a lens assembly (e.g., a series of typically electrostatic ion lenses) that assist in extracting the ions from the interface section, focusing the ions as an ion beam, and accelerating the ions into the ion trap 112, or first into an ion guide section positioned between the ion optics and the ion trap 112. The ion optics section and/or ion guide section may be maintained at an operating pressure of for example around $10^{-4}$ Torr or lower by a suitable pump (e.g., a turbomolecular pump). The ion guide section if provided may include a suitable ion guide, particularly a quadrupole device. Depending on the embodiment, the ion guide may be configured as an RF-only guide or as a mass filter (with or without mass scanning).

Generally, the ion trap 112 may be any device configured to trap (i.e., confine or store) the ions of the ion pulse produced by and outputted from the ICP ion source 108 (and possibly received from additional, intermediate components as just described) for a desired trapping or confinement period, and thereafter mass-selectively eject the ions from the ion trap 112 for measurement by the ion detector 116. That is, the ion trap 112 is configured to implement both trapping (confinement or storage) and mass-selective ejection (MSE) of ions. In the present context, "trapping" the ions means that after the ion pulse is injected into the interior of the ion trap 112, the ion trap 112 limits the trajectories of the ions in three-dimensional (3D) space and prevents the ions from exiting the interior (such as through an ion entrance 144 or an ion exit 148 of the ion trap 112) for the duration of the prescribed confinement period. In the present context, "MSE" means that ions of selected ion masses are sequentially ejected from the interior on a mass-selective basis. For example, the ions of the ion pulse injected into the ion trap 112 may fall in a mass range of 100 u to 200 u. The ion trap 112 is configured to eject the trapped ions of different masses sequentially, e.g., 100 u, then 110 u, then 120 u, etc. The order in which the ions are ejected may be from low mass to high mass, or high mass to low mass, or may be (pseudo-)random.

The ion trap 112 may also include a gas inlet 152 separate from the ion entrance 144 and the ion exit 148 configured to conduct an appropriate gas from a gas source into the interior of the ion trap 112. The neutral gas molecules maintain the interior at a desired gas pressure. Depending on the embodiment and the composition of the ions, the neutral gas molecules interact with the injected/trapped ions by collisions or additionally by reactions. Thus, the gas may be a buffer gas that reduces the kinetic energy of the ions (cools or thermalizes the ions), or may be a reaction gas that reacts with one or more types of the ions. In the latter case, the ion trap 112 may also function as a reaction cell in the ICP-MS system 100. Examples of non-reactive buffer gases (gases that are inert to the ions being processed) typically utilized include, but are not limited to, hydrogen (which is inert depending on the type of ion), helium, nitrogen, neon, and mixtures of two or more of the foregoing. Examples of reaction gases typically utilized include, but are not limited to, hydrogen, oxygen, water (vapor), air, ammonia, methane, fluoromethane, nitrous oxide, and mixtures of two or more of the foregoing reaction gases and/or non-reactive buffer gases such as those just noted.

In an embodiment, the ion trap 112 is configured as a linear (two-dimensional multipole) ion trap (LIT) as described further below. Alternatively, the ion trap 112 may have another type of configuration. Besides an LIT, examples of other types of ion traps include, but are not limited to, three-dimensional multipole ion traps (e.g., Paul traps), electrostatic traps (e.g., Kingdon, Knight or ORBITRAP® traps), and ion cyclotron resonance (ICR) traps (e.g., Fourier transform ICR (FT-ICR) traps, Fourier transform mass spectrometer (FTMS) traps, or Penning traps).

The ion detector 116 may be any device configured for collecting and measuring the flux (or current) of ions outputted (in particular, mass-selectively ejected) from the ion trap 112. Examples of ion detectors include, but are not limited to, electron multipliers, photomultipliers, microchannel plate (MCP) detectors, image current detectors, and Faraday cups.

The ICP-MS system 100 may include additional, intermediate components (not shown) positioned between the ion trap 112 and the ion detector 116 that are configured to facilitate the transport of the ejected from the ion trap 112 to the ion detector 116. For example, an ion guide section may be positioned between the ion trap 112 and the ion detector 116. The ion guide section if provided may include a suitable ion guide, particularly a quadrupole device. Depending on the embodiment, the ion guide may be configured as an RF-only guide or as a mass filter (with or without mass scanning).

The system controller (or controller, or computing device) 128 may include one or more modules configured for controlling, monitoring and/or timing various functional aspects of the ICP-MS system 100 such as, for example, controlling the operations of the sample introduction section 104, the ICP ion source 108, the ion trap 112 (including the ion source power supply 120), the ion detector 116 (including the ion trap power supply 124), and any intermediate components between the ICP ion source 108 and the ion trap 112 or between the ion trap 112 and the ion detector 116 (e.g., ion optics, ion guides, etc.), as well as controlling the vacuum system and various gas flow rates, temperature and pressure conditions, and other sample processing components provided in the ICP-MS system 100 that require control. The system controller 128 is representative of the electrical circuitry (e.g., RF, other AC, and DC voltage sources) utilized to operate the foregoing components. The system controller 128 may also be configured for receiving the detection signals from the ion detector 116 and performing other tasks relating to data acquisition and signal analysis as necessary to generate data (e.g., a mass spectrum) characterizing the sample under analysis. The system controller 128 may include a non-transitory computer-readable medium that includes non-transitory instructions for performing any of the methods disclosed herein. The system controller 128 may include one or more types of hardware, firmware and/or software, as well as one or more memories and databases, as needed for operating the various components of the ICP-MS system 100. The system controller 128 typically includes a main electronic processor providing overall control, and may include one or more electronic processors configured for dedicated control operations or specific signal processing tasks. The system controller 128 may also include one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software, and devices for loading media readable by the electronic processor (e.g., non-transitory logic instructions embodied in software, data, and the like). The system controller 128 may include an operating system (e.g., Microsoft Windows® software) for controlling and managing various functions of the system controller 128.

The ICP-MS system 100 may be operated to conduct a multi-element analysis by ICP-MS on a sample, in particular a single sample as described herein, as follows. The sample is ionized by ICP ionization to produce an ion pulse as described above. The ion pulse includes an ensemble or plurality of ions having two or more different masses—that is, a mixture of different ions falling within some mass range. The ions may (primarily) include analyte ions derived from the sample material, or additionally may include interfering ions as described herein. The ion pulse is then injected into the ion trap 112 by, for example, utilizing appropriate ion optics and/or ion guides. In an embodiment, the ion trap 112 is operated to execute four steps or stages: an ion injection step, an ion confinement (trapping) step, an ion ejection step (particularly by MSE as described herein), and an ion trap clearing (or ion purging) step. These four steps may be repeated at a certain repetition rate while ion pulses produced from respective particles or cells are arriving at the ion entrance 144 of the ion trap 112 one by one. In LA imaging, the four steps may be repeated synchronously with the repetition of laser shots. Depending on the particular analytical run of the ICP-MS system 100 (e.g., the type of sample, experimental conditions, etc.), the ion trap clearing step may not be necessary and therefore may be optional.

During the ion injection step, the ion entrance 144 of the ion trap 112 is in an open state while the ion exit 148 is in a closed state. The open state of the ion entrance 144 corresponds to a condition that allows the ion pulse to enter the interior of the ion trap 112 through the ion entrance 144. The closed state of the ion exit 148 corresponds to a condition that prevents (blocks) the injected ions from escaping the ion trap 112 through the ion exit 148. The period of time over which the injection step is executed, referred to herein as the injection period, generally should be determined based on the properties of the transient signals (or more precisely, the duration of the ion pulse and the frequency of the ion pulses arriving at the ion entrance 144) to be trapped and analyzed. The injection period should be long enough to ensure (with high probability) that the entire ion pulse (representative of the entire single sample) enters the ion trap 112, because if the injection period is shorter than the pulse duration, the trapped ions would represent only a portion of the particle or other type of single sample. On the other hand, the injection period should not be so long as to allow part or all of the succeeding (next) ion pulse to also enter the ion trap 112. The sample introduction section 104 may be configured or operated to control the number density of the particles or cells in the sample material to sufficiently lower the probability of more than one ion pulse (representing one particle or cell) entering the ion trap 112 during the injection period. In other words, the injection period should have a duration that ensures that only one ion pulse (or no pulse) will be trapped during one iteration of the four-stage operation of the ion trap 112, i.e. so that multiple ion pulses are not trapped. In the sp(sc) ICP-MS mode, the injection period typically is the period during which the ion entrance 144 is open and waiting for an ion pulse to arrive. The ion injection period may correspond to the dwell time in a standard spICP-MS experiment. In LA imaging, the injection period may be set to a period equivalent to the width of the ion pulses, because the time of opening the ion entrance 144 can be coincided with the time of arrival of the ion pulse at the ion entrance 144.

As an example, the duration of the injection period may be (about) one order of magnitude longer than the width of the ion pulses generated from the single samples, and at the same time sufficiently shorter than the average time interval of the pulses arriving at the ion entrance. Here, the width of an ion pulse may correspond to the full width at half maximum (FWHM) of the ion pulse. In a specific example, the duration of the injection period may be on the order of a few milliseconds (e.g., less than 10 ms) when the width of the ion pulses are less than 1 ms and the frequency of the ion pulses is about 1000 per minute (the average time interval between two successive pulses is about 60 ms). In a more specific example of an experiment, the injection period was set to 4 ms or 5 ms, which was about one order of magnitude longer than the width of the ion pulses generated from nanoparticles or yeast cells, where FWHMs of the ion pulses typically ranged from 0.3 ms to 0.5 ms), when the number density of the nanoparticles or yeast cells in suspension was adjusted so that the average time interval between two successive pulses was longer than 40 ms, about one order of magnitude longer than the injection period.

During the ion confinement (trapping) step, the ions of the injected ion pulse are confined in the ion trap 112 during a period of time referred to herein as the confinement period. Over the duration of the confinement period, the ion trap 112 prevents the confined ions from exiting the ion trap 112 and prevents other ions outside of the ion trap (such as other ion pulses outputted by the ICP ion source 108) from entering the ion trap 112. The injection period is transitioned to the confinement period (the ion injection ends and the ion confinement step begins) by switching (or adjusting) the ion entrance 144 of the ion trap 112 from its open state to a closed state, while the ion exit 148 remains in its preexisting closed state. Similar to the closed state of the ion exit 148, the closed state of the ion entrance 144 corresponds to a condition that prevents (blocks) the injected ions from escaping the ion trap 112 through the ion entrance 144. The duration of the confining period generally should be long enough to store (or park) the injected ions (separate from other ion pulses) in preparation for the subsequent ejection step. In an embodiment, the duration of the confining period is on the order of milliseconds (e.g., 3 to 5 ms).

Generally, the ion trap 112 is configured to confine the injected ions by limiting the extent of their trajectories in 3D space, such that the ions are concentrated or focused along a central axis or a central region of the interior of the ion trap 112. The specific mechanism for trapping the ions in this manner depends on the type of ion trap 112 utilized. In the case of a linear ion trap (LIT) defined by a set of parallel rod electrodes, the ion trap 112 confines the ions radially by generating (in its interior) a two-dimensional RF electric field (also referred to herein as a main RF electric field or an ion confining RF electric field) between the rod electrodes, and confines the ions axially by generating DC potential barriers (by applying stopping potentials) at or near the opposing axial ends of the rod electrodes (i.e., at the ion entrance 144 and the ion exit 148). In addition, an axial DC potential gradient may be generated along the axial length of the LIT (e.g., by applying a DC voltage between the axial ends of each rod electrode) to urge the injected ions in a direction toward the ion exit 148 during the ion injection, confinement, and the ejection steps. In particular, the axial DC field may improve the efficiency of the axial ion confinement in the LIT.

As non-exclusive alternative examples, in the case of a 3D quadrupole ion trap defined by a ring electrode between a pair of opposing end cap electrodes, the ion trap 112 confines the ions by generating a three-dimensional RF electric field. In the case of an ion cyclotron resonance (ICR) cell, the ion trap 112 utilizes a combination of RF and magnetic fields to confine the ions. In the case of an electrostatic ion trap, the ion trap 112 utilizes one or more electrostatic fields to confine the ions.

During the operation of the ion trap 112, a gas as described above is flowed into the ion trap 112 via the gas inlet 152 at a flow rate effective for maintaining the ion trap 112 at a desired pressure. In one non-exclusive example, the pressure in the ion trap 112 may be in the range from $10^{-1}$ to $10^{-3}$ Torr. The gas pressure, as well as the duration of the confinement period, are effective to ensure a number of collisions between the gas molecules and the confined ions sufficient to kinetically cool the confined ions. The reduction in ion kinetic energy favorably conditions the ions for undergoing MSE in the subsequent ejection step. In some embodiments, the gas supplied to the ion trap 112 serves not only as buffer gas but also as a reaction gas. In such embodiments, the reaction gas is selected so as to react with one or more of the injected ions (i.e., one or more types of ions) during the confinement period as well as the injection period, where the reaction is effective to suppress interfering ion signal intensity as measured by the ion detector 116.

In an embodiment, the ion trap 112 is configured to implement an ion rejection step as part of the ion confinement step. The ion rejection step entails removing unwanted ions (e.g., ions of certain masses that are of little or no analytical value to the experiment being conducted) from the ion trap 112. Removing unwanted ions may be useful for lowering the charge density in the ion trap 112, which may improve the performance of the ion trap 112. As an example, when configured as a quadrupole, the ion trap 112 may be configured to remove unwanted ions by implementing a notch filtering technique, which may be similar to the MSE technique utilized during the subsequent ion ejection step. Examples of notch filtering are described in U.S. Pat. Nos. 5,598,001 and 5,672,870, the contents of each of which are incorporated by reference herein.

During the ion ejection step, ions of selected masses confined in the ion trap 112 are ejected from the ion trap 112 by MSE during a period of time referred to herein as the ejection period. In one non-exclusive embodiment, the selected ions are ejected through the ion exit 148 of the ion trap 112. In this case, the ion exit 148 is switched (adjusted) from its closed state to an open (or partially open) state, which corresponds to a condition that allows the selected ions to pass through the ion exit 148 while continuing to prevent (block) other (non-selected) ions in the ion trap 112 from passing though the ion exit 148. During the ion ejection step, the ion entrance 144 may be maintained in its closed state. The duration of the ejection period is long enough to allow all selected ion masses to be sequentially ejected by MSE. In an embodiment, the duration of the ejection period is on the order of milliseconds per mass (e.g., 1 to 3 ms).

In one non-exclusive embodiment, when configured as a quadrupole device, the ion trap 112 may be configured to implement MSE by a resonant ejection technique such as dipole or quadrupole excitation. Resonant ejection entails superimposing an auxiliary alternating-current (AC) electric field (or excitation field) on the ion-confining RF electric field, and scanning an operating parameter (voltage amplitude or frequency) of the auxiliary AC electric field or the RF electric field to eject ions in mass succession. In a linear ion trap (LIT), axial ejection (ejection in the axial direction) may be implemented, i.e., through the axially positioned ion exit 148. Alternatively, radial ejection may be implemented, whereby ions are ejected in a radial direction through a slot or aperture of one or more of the rod electrodes. As an alternative to resonant ejection, a mass-instability ejection technique may be utilized.

As the ions of each mass are successively ejected from the ion trap 112, they are successively transmitted to the ion detector 116 for measurement. Appropriate ion optics and/or ion guides may be utilized between the ion trap 112 and the ion detector 116 to facilitate the transport of the ejected ions. In typical embodiments, examples of ejected ions include, but are not limited to, positive monatomic ions of a metal or other element (except for a rare gas such as argon). In some embodiments, when measures are taken to suppress the interference of analyte ions, the ejected ions may include product ions produced by reacting a reaction gas in the ion trap 112 with positive monatomic ions of a metal or other element (except for a rare gas).

The ion detector 116 measures (i.e., detects and counts) each the ions of each ejected mass and outputs an electronic detector signal (ion measurement signal) to the data acquisition component of the system controller 128. The MSE carried out by the ion trap 112 enables the ion detector 116 to detect and count ions having a specific m/z ratio (mass) separately from ions having other m/z ratios (derived from different analyte elements of the single sample), and thereby produce ion measurement signals for each ion mass (and hence each analyte element) from a single ion pulse being analyzed. Ions with different m/z ratios may be detected and counted in sequence for each ion pulse. The system controller 128 processes the signals received from the ion detector 116 and generates a mass spectrum for each ion pulse (for each single sample), which shows the relative signal intensities (abundances) of each ion detected, indicating the elemental composition of the single sample, as the signal intensity so measured at a given m/z ratio (and therefore a given analyte element) is directly proportional to the abundance of that element in the single sample processed by the ICP-MS system 100. In this manner, the existence of chemical elements contained in each single sample being analyzed can be confirmed and the elemental composition of each sample can be determined.

After completing the ion ejection step, the ion trap 112 may implement the ion trap clearing step to empty the ion trap 112 of ions remaining therein. The ion trap clearing step may be effected by creating one or more pathways for the residual ions to exit the trap. As examples, the ion exit 148 may be opened fully, or the RF voltage potentials utilized to constrain ion motion in the previous steps may be turned off. Clearing the ion trap 112 is useful in preparation for repeating the next cycle of the steps of ion injection, ion confinement, and ion ejection.

As noted, the cycle may be repeated one or more times to respectively analyze one or more additional ion pulses produced from respective particles or cells are arriving at the ion entrance 144 of the ion trap 112 one by one.

Figure 2:
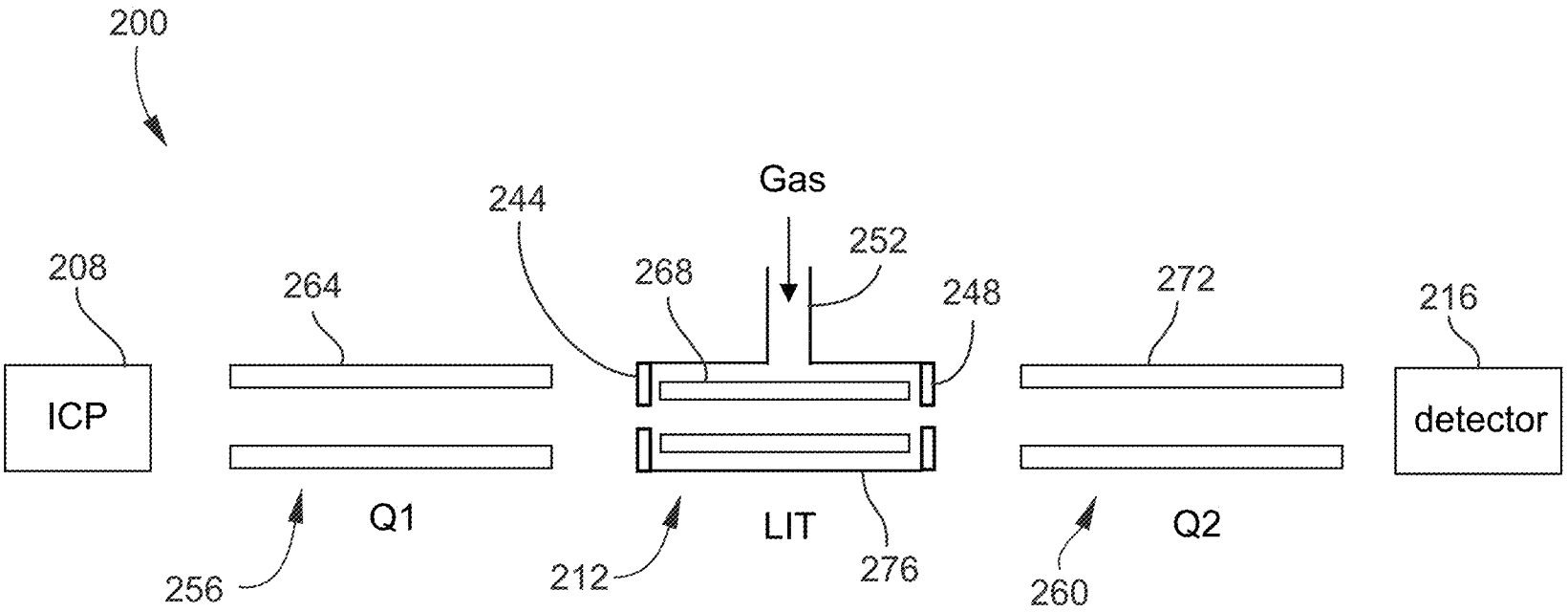
FIG. 2 is a schematic view of an example of an inductively coupled plasma-mass spectrometry (ICP-MS) system having a Q1-LIT-Q2 configuration, according to another embodiment of the present disclosure.

FIG. 2 is a schematic view of an example of an inductively coupled plasma-mass spectrometry (ICP-MS) system 200 according to another embodiment. The ICP-MS system 200 is based on a triple quadrupole (QQQ) configuration. That is, the ICP-MS system 200 includes three linear quadrupole devices arranged in series along the main ion optical axis: a first (or pre-LIT) linear quadrupole ion guide (Q1) 256, followed by a linear quadrupole ion trap (LIT) 212, and a second (post-LIT) linear quadrupole ion guide (Q2) 260. The first ion guide 256 is axially positioned between an ICP ion source 208 (as described herein) and the LIT 212, and the second ion guide 260 is axially positioned between the LIT 212 and an ion detector 216 (as described herein). The configuration of the ICP-MS system 200 may be referred to as a Q1-LIT-Q2 configuration.

The first ion guide 256 includes a set of four rod electrodes 264, the LIT 212 includes a set of four rod electrodes 268, and the second ion guide 260 includes a set of four rod electrodes 272. In FIG. 2, for simplicity only two rod electrodes are illustrated for each quadrupole device. In the present context, the term "rod electrode" is used in a general sense to denote an electrode that is appreciably elongated in one dimension (e.g., axially elongated) as illustrated in FIG. 2. The shape of the rod electrode may be cylindrical, polygonal (e.g., as a plate or bar), or include a hyperbolic curved surface (profile) facing the interior surrounded by the rod electrode set. Typically, for each quadrupole device, the rod electrodes are parallel to each other and to the ion optical axis (corresponding to the central, longitudinal axis of the quadrupole device, are spaced from the ion optical axis by a certain field radius $R_o$ (which may be different in each device) and are circumferentially spaced from each other by equal distances about the ion optical axis.

The LIT 212 includes a housing 276 enclosing the rod electrodes 268, and a gas inlet 252 as described above for conducting gas into the enclosed interior of the LIT 212. During operation, the LIT 212 is filled with a gas of selected composition and maintained at a controlled gas pressure as described herein. The LIT 212 also includes an ion entrance lens 244 located at (or corresponding to) its ion entrance, and an ion exit lens 248 located at (or corresponding to) its ion exit. As a non-exclusive example, the ion entrance lens 244 and the ion exit lens 248 may be plate-shaped electrodes with apertures on the ion optical axis. Enclosures (not shown) for the first ion guide 256 and the second ion guide 260 are configured to maintain the first ion guide 256 and the second ion guide 260 under sub-atmospheric (e.g., vacuum-level) conditions. As non-exclusive examples, the first ion guide 256 operates at a gas pressure in a range from $10^{-4}$ Torr to $10^{-6}$ Torr, the LIT 212 operates at a gas pressure in a range from $10^{-1}$ Torr to $10^{-3}$ Torr, and the second ion guide 260 operates at a gas pressure in a range from $10^{-4}$ Torr to $10^{-6}$ Torr. Other ion optics components (not shown) may be provided at or near the ion entrances and ion exits of the first ion guide 256 and/or second ion guide 260 as needed.

Depending on the embodiment or experiment to be conducted, the first ion guide 256 and the second ion guide 260 are configured or operated as RF-only ion guides or as mass (bandpass) filters, with or without performing a scanning operation. For example, the first ion guide 256 may be operated as a mass filter, without scanning, to allow only a certain mass range of ions to enter the LIT 212. In other words, ions outputted from the ICP ion source 108 having masses outside of the mass range (passband) at which the first ion guide 256 is tuned (i.e., masses below the low-mass cutoff point and above the high-mass cutoff point of the first ion guide 256) are rejected by the first ion guide 256 (i.e., do not pass through the ion exit of the first ion guide 256). For example, the first ion guide 256 may be tuned to reject non-target analyte ions and matrix component ions, thereby reducing the amount of unwanted ions entering the LIT 212 and/or preventing the formation of unwanted (and potentially interfering) product ions in the LIT 212. As another example, the second ion guide 260 may be operated as a mass filter, in some cases with scanning (i.e., as a mass analyzer), to improve the mass resolution of the LIT 212 if needed for a particular embodiment or experiment.

In an alternative embodiment, the ICP-MS system 200 may have a double quadrupole configuration in which either the first ion guide 256 or the second ion guide 260 is not provided (or at least a quadrupole-based device is not provided in the pre-LIT (Q1) or post-LIT (Q2) position). In other words, the first ion guide 256 or the second ion guide 260 may be optional in some embodiments.

Figure 3A:
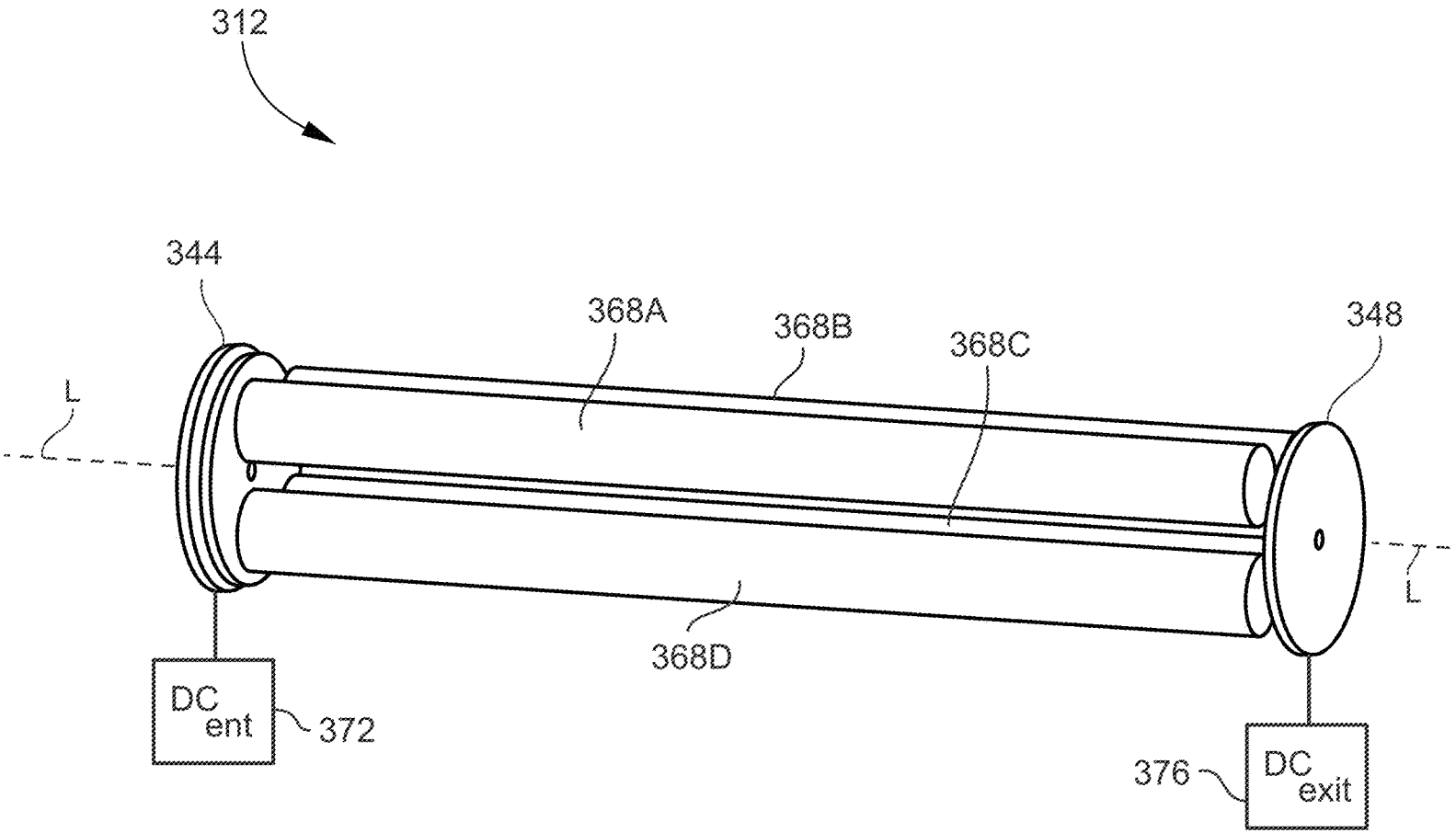
FIG. 3A is a schematic perspective view of an example of a quadrupole device according to an embodiment of the present disclosure.

FIG. 3A is a schematic perspective view of an example of a quadrupole device 312 that may be representative of the first ion guide 256, the LIT 212, and/or the second ion guide 260 described herein. The quadrupole device 312 includes a set of four ion guide electrodes (or rod electrodes) 368A, 368B, 368C, and 368D arranged in a linear quadrupole configuration along a device axis (ion optical axis) L of the quadrupole device 312. In this configuration, the ion guide electrodes 368A, 368B, 368C, and 368D are elongated along the device axis L (typically in parallel with each other and with the device axis L), circumferentially spaced from each other about the device axis L, and positioned at a radial distance from (and orthogonal to) the device axis L. In the present context, a radial distance runs in a direction in the transverse plane orthogonal to the device axis L. Accordingly, the ion guide electrodes 368A, 368B, 368C, and 368D define an ion guide entrance, an ion guide exit axially spaced from the ion guide entrance by an axial length of the ion guide electrodes 368A, 368B, 368C, and 368D, and an axially elongated ion guide interior extending from the ion guide entrance to the ion guide exit. Typically, each opposing pair (368A/368C, and 368B/368D) of the ion guide electrodes 368A, 368B, 368C, and 368D are electrically interconnected. The quadrupole device 312 may also include (particularly in the case of the LIT described herein) an ion entrance lens 344 and an ion exit lens 348 respectively positioned at the opposing axial (entrance and exit) ends of the ion guide electrodes 368A, 368B, 268C, and 368D.

The quadrupole device 312 further includes, or at least is in communication with, an electrical power supply and associated electronics. In FIG. 3A, a portion of the power supply/electronics is schematically represented by an entrance DC potential source 372 communicating with the ion entrance lens 344 and an exit DC potential source 376 communicating with the ion exit lens 348. The entrance DC potential source 372 is configured to apply an entrance DC potential $DC_{ent}$ to the ion entrance lens 344. The exit DC potential source 376 is configured to apply an exit DC potential $DC_{exit}$ to the ion exit lens 348. The entrance DC potential source 372 and the exit DC potential source 376 are configured to switch the entrance DC potential $DC_{ent}$ and the exit DC potential $DC_{exit}$, respectively, between a first (high) magnitude and a second (low) magnitude (e.g. −50 V). In this way, the ion entrance lens 344 and the ion exit lens 348 each operate as an ion gate having an open (ON) state that passes ions and a closed (OFF) state that blocks ions (i.e, reflects ions as an electrostatic mirror). The entrance DC potential source 372 and/or the exit DC potential source 376 may also be configured to adjust (vary) the entrance DC potential $DC_{ent}$ and/or the exit DC potential $DC_{exit}$ to one or more intermediate magnitudes between the first (high) and the second (low) magnitudes, to thereby operate the ion entrance lens 344 and/or the ion exit lens 348 in a semi-open state.

Figure 3B:
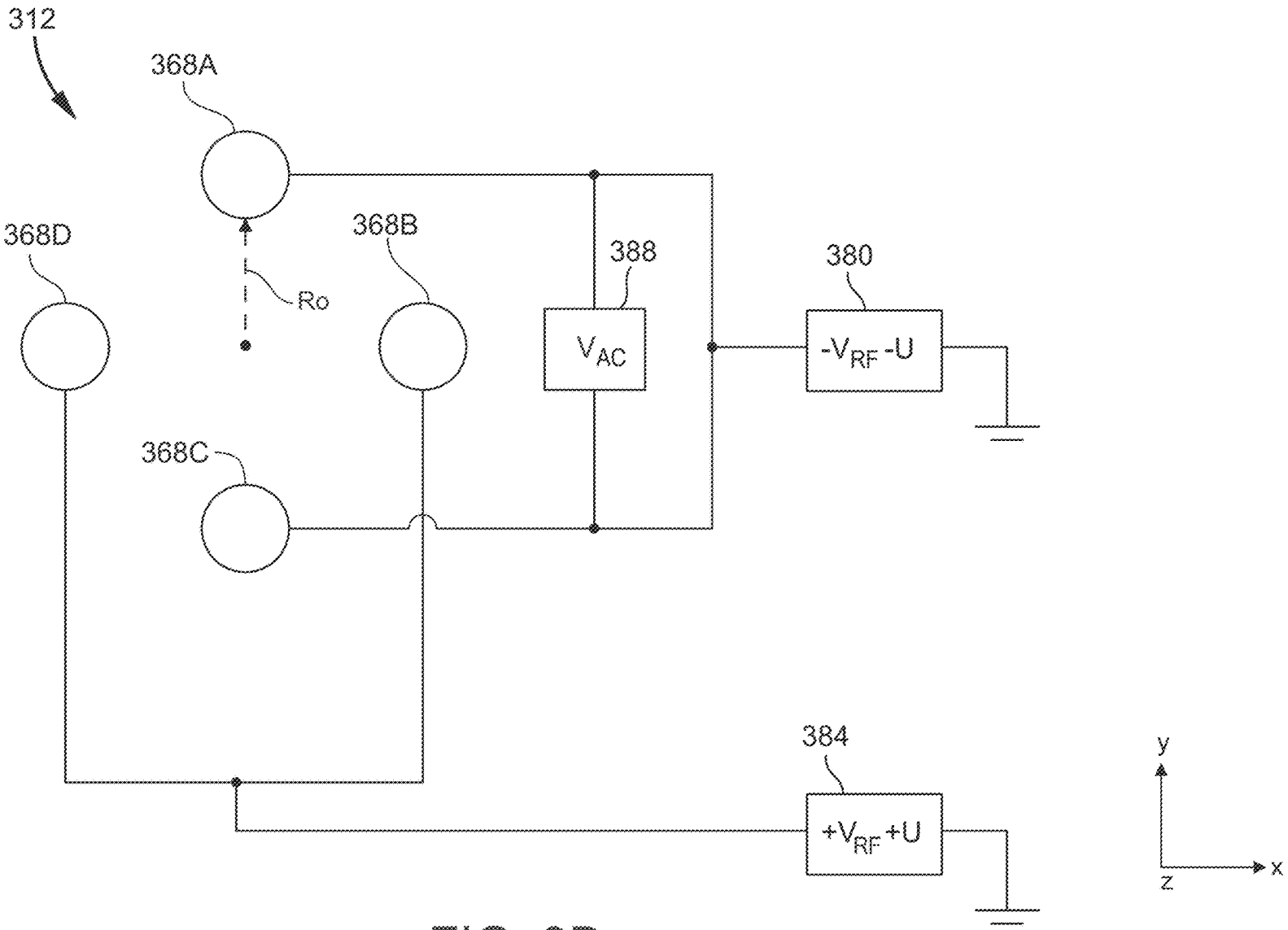
FIG. 3B is a schematic cross-sectional view of the quadrupole device illustrated in FIG. 3A, taken in a transverse plane orthogonal to the ion optical axis of the quadrupole device.

FIG. 3B is a schematic cross-sectional view of the quadrupole device 312, taken in the transverse plane orthogonal to the device axis L at an intermediate point along the axial length of the ion guide electrodes 368A, 368B, 368C, and 368D. In FIG. 3B, other portions of the power supply/electronics are schematically represented. The specific configuration of these other portions depend on the embodiment and whether the quadrupole device 312 is configured or operated as the first ion guide 256, the LIT 212, or the second ion guide 260 described herein. In the illustrated example, the quadrupole device 312 includes a main (or ion confining) RF potential source, and may additionally include a quadrupole (or ion confining) DC potential source (the RF and DC sources being depicted together, at 380 and 384) and/or an auxiliary AC potential source 388.

The main RF potential source 380 and 384 is configured apply a main (or ion confining) RF potential to the ion guide electrodes 368A, 368B, 368C, and 368D at a frequency SI and amplitude $V_{RF}$ effective to generate a two-dimensional, time-varying RF electric field in the interior volume of the quadrupole device 312 surrounded (inscribed) by the ion guide electrodes 368A, 368B, 368C, and 368D. The RF potential applied to one opposing pair of the ion guide electrodes (electrode pair 368A/368C) is 180 degrees (it radians) out of phase with the RF potential applied to the other opposing pair of ion guide electrodes (electrode pair 368B/368D). For example, $-V_{RF}$ cos (Ωt) is applied to the electrode pair 368A/368C while $+V_{RF}\cos(\Omega t)$ is applied to the electrode pair 368B/368D. The RF potentials may be superimposed on a DC bias potential (not schematically shown) applied to all four ion guide electrodes 368A, 368B, 268C, and 368D. In this case, the electric potential applied to the electrode pair 368A/368C may be expressed as $-V_{RF}$ $DC_{bias}$, and the electric potential applied to the other electrode pair 368B/368D may be expressed as $+V_{RF}+DC_{bias}$, where the negative and positive signs of the RF potential indicate the 180-degree phase difference at any given instant of time. In an embodiment, the applied DC bias potential may have a constant, negative magnitude along the axial lengths of the guide electrodes 368A, 368B, 368C, and 368D.

The main RF electric field radially confines the ions in the quadrupole device 312, i.e., limits the motions of the ions in the radial direction, thereby focusing the ions as an ion beam concentrated on the device axis L. In this manner, the quadrupole device 312 may operate as an RF-only ion guide in which the RF electric field functions only to focus the ions along the device axis L.

In certain embodiments, the first ion guide 256 and/or the second ion guide 260 described above in conjunction with FIG. 2 may operate as an RF-only ion guide.

The quadrupole DC potential source 380 and 384 (if the DC component is provided) is configured apply a quadrupole DC electric field (i.e., two DC electric fields with magnitudes of opposite polarities, ±U) to the opposing pairs ion guide electrodes 368A, 368B, 368C, and 368D. This quadrupole DC electric field is superimposed on the main RF electric field, resulting in a composite RF/DC electric field. In this case, disregarding the above-noted DC bias potential that may be applied to all four ion guide electrodes 368A, 368B, 368C, and 368D, the electric potential applied to the electrode pair 368A/368C may be expressed as $-V_{RF}-U$, and the electric potential applied to the other electrode pair 368B/368D may be expressed as $+V_{RF}+U$.

The composite RF/DC electric field enables the quadrupole device 312 to operate as a mass filter that imposes a tunable mass range (passband) of which both the low-mass cutoff point and high-mass cutoff point are controllable (adjustable). According to known principles, by appropriately selecting the operating parameters of the composite RF/DC field (RF amplitude $V_{RF}$, RF frequency Ω, and DC magnitude U), the quadrupole device 312 as a mass filter can be configured to impose a mass range having a width that allows only a single ion mass, or a narrow range of ion masses (from a low-mass cut-off point to a high-mass cut-off point), to pass through the interior volume of the quadrupole device 312. Ions having masses within the mass bandpass have stable trajectories and are able to traverse the entire length of the quadrupole device 312. Ions having masses outside the mass bandpass have unstable trajectories and thus will be rejected and removed from the interior volume (e.g., by colliding with or passing between the ion guide electrodes 368A, 368B, 368C, and 368D). That is, such ions will overcome the RF confining field and be removed from the quadrupole device 312 without the possibility of exiting the quadrupole device 312 at the axial exit end thereof. The mass bandpass can be adjusted by scanning (adjusting or varying) one or more of the operating parameters of the composite RF/DC field, enabling the selection of a specific ion mass or masses to be transmitted out from the quadrupole device 312 at any given time.

The stability of ions in the quadrupole device 312 is described by the Mathieu operating parameters a and q, which are expressed as:

$$a = \frac{8zU}{mR_0^2\Omega^2} \text{ and} \tag{1}$$

$$q = \frac{4zV_{RF}}{mR_0^2\Omega^2}, \tag{2}$$

where U is the magnitude of the applied quadrupole DC potential, $V_{RF}$ is the amplitude of the applied quadrupole RF potential, $R_o$ is the field radius from the device axis L of the interior volume inscribed by the ion guide electrodes 368A, 368B, 368C, and 368D, Ω is the main drive frequency of applied quadrupole RF potential, and m/z is the mass-to-charge ratio of an ion in question.

At any instant of time, the stability of an ion of a given mass (or, more precisely, m/z ratio) in the interior volume of the quadrupole device 312 depends on the variables of the Mathieu operating parameters a and q. With the field radius $R_0$ fixed by geometry and the main drive angular frequency Ω also typically fixed (held constant) during operation, the stability of an ion is dictated solely by the values set for the DC potential U and RF potential $V_{RF}$, which are tunable. Thus, the DC potential U and RF potential $V_{RF}$ may be set to define the mass range of ions transmitted by the quadrupole device 312, or additionally may be varied to implement a mass scanning mode by which ions of successively higher or lower masses become stable or unstable. In the case of an RF-only ion guide, U=0 and thus the operating parameter a=0, and therefore only the operating parameter q is relevant to ion stability.

In certain embodiments, the first ion guide 256 and/or the second ion guide 260 described above in conjunction with FIG. 2 may operate as a mass filter, with or without implementing the mass scanning function. The LIT 212 described above in conjunction with FIG. 2 also may generate a composite RF/DC field if such control over the mass range transmitted through the LIT 212 is desired.

When configured or operated as an ion trap having the MSE capability, the quadrupole device 312 includes the auxiliary AC potential source 388. The auxiliary AC potential source 388 is configured to apply an auxiliary (or supplemental) AC potential of the general form $V_{AC}\cos(\omega t)$ to one opposing pair of the ion guide electrodes 368A, 368B, 368C, and 368D (electrode pair 368A/368C in the illustrated example) at a frequency ω and amplitude $V_{AC}$ effective to generate an auxiliary AC dipole electric field in the interior volume of the quadrupole device 312, which is superimposed on the ion confining, main quadrupole RF (or composite RF/DC) electric field. The operating parameters of the auxiliary AC electric field are set relative to those of the main quadrupole RF electric field to excite an ion of a selected mass by resonant excitation, thereby increasing the kinetic energy of the selected ion along the transverse axis (e.g., y-axis) of the electrode pair (e.g., 368A and 368C) to which the dipole auxiliary AC potential is applied. When an ion excited in this manner gains enough kinetic energy, it overcomes the restoring force imparted by the main quadrupole RF electric field and is ejected from the internal ion confining (trapping) volume of the quadrupole device 312. During the process of exciting and ejecting this particular ion (ions of this particular mass), all other ions (ions of different masses that are unexcited by the auxiliary AC electric field under the current operating parameters) remain trapped in the quadrupole device 312.

Specifically, a trapped ion is kinetically excited in the radial direction (on the transverse axis (e.g., y-axis) of the electrode pair (e.g., 368A and 368C) to which the dipole auxiliary AC potential is applied) if the secular frequency of the ion (the frequency of its oscillatory motion in the main quadrupole RF electric field) coincides with the frequency $\omega$ of the auxiliary AC potential. This matching of the excitation frequency $\omega$ to the ion secular frequency results in a condition of resonance that enables energy to be efficiently added to the kinetic energy of the selected ion. In the linear quadrupole configuration of the quadrupole device 312, the angular secular frequency $\omega_s$ is determined by a certain function $\beta(q)$ of the Mathieu operating parameter q (Equation 2 above) and the angular frequency $\Omega$ of the main quadrupole RF potential, as follows:

$$\omega_s = \frac{\beta(q)\Omega}{2} \tag{3}$$

Because the angular secular frequency $\omega_s$ remains the same as long as the values for q and $\Omega$ are unchanged, the mass m of the ions that have a certain secular frequency is proportional to the RF amplitude $V_{RF}$. Therefore, with a fixed frequency $\omega$ of the auxiliary AC potential applied, the trapped ions are excited in the order of mass as the RF amplitude $V_{RF}$ increases. Thus, MSE may be executed by scanning the RF amplitude $V_{RF}$. Here, it is noted that before executing the MSE step (i.e., during the ion injection and ion confinement steps described herein), the RF amplitude $V_{RF}$ should be set to the value at which the low mass cut-off is lower than the lowest mass of the analyte ions to be trapped. The low mass cut-off is the mass of the lightest ion that can be radially confined (trapped) by the main quadrupole RF electric field, which gives the q value of about 0.907. The lighter ions that give q values greater than about 0.907 are radially expelled from the quadrupole ion guide by the main quadrupole RF electric field.

More generally, at least one operating parameter of the auxiliary AC potential (e.g., AC frequency $\omega$ or AC amplitude $V_{AC}$) and/or the main RF potential (e.g., main RF drive frequency $\Omega$ or main RF amplitude $V_{RF}$) may be scanned (adjusted or varied) to resonantly excite different ions in order of mass.

By the foregoing configuration, the quadrupole device 312 as an ion trap is able to perform MSE by resonant excitation.

In an alternative embodiment, the quadrupole device 312 may implement resonant quadrupole excitation instead of resonant dipole excitation, as appreciated by persons skilled in the art. One example of quadrupole excitation is described in U.S. Pat. No. 5,672,870, the entire contents of which are incorporated by reference herein.

The amplitude of the oscillatory motion of a resonantly excited ion increases in the radial direction parallel to the plane containing the opposing electrode pair utilized to apply the dipole excitation field. A sufficiently great dipole excitation would cause the excited ion to strike one of the electrodes, resulting in ion loss. However, at least one of the electrodes utilized the dipole excitation may have a slit-like hole that passes from the inner side to the outer side of the electrode. In this case, resonant ion ejection may be executed in the radial direction by the excited ion exiting the quadrupole device 312 through the slit-like hole. However, the direction in which the resonantly excited ion is ultimately ejected depends on the embodiment. The resonant ion ejection may be in the axial direction through the ion exit (e.g., the ion exit lens 348) of the quadrupole device 312, as described further below, when the resonant excitation is moderate enough to keep the excited ions from striking the electrode. Axial ion ejection is useful when the ion trap is a LIT integrated in a multiple linear quadrupole type of arrangement such as the ICP-MS system 200 described herein.

Figure 3C:
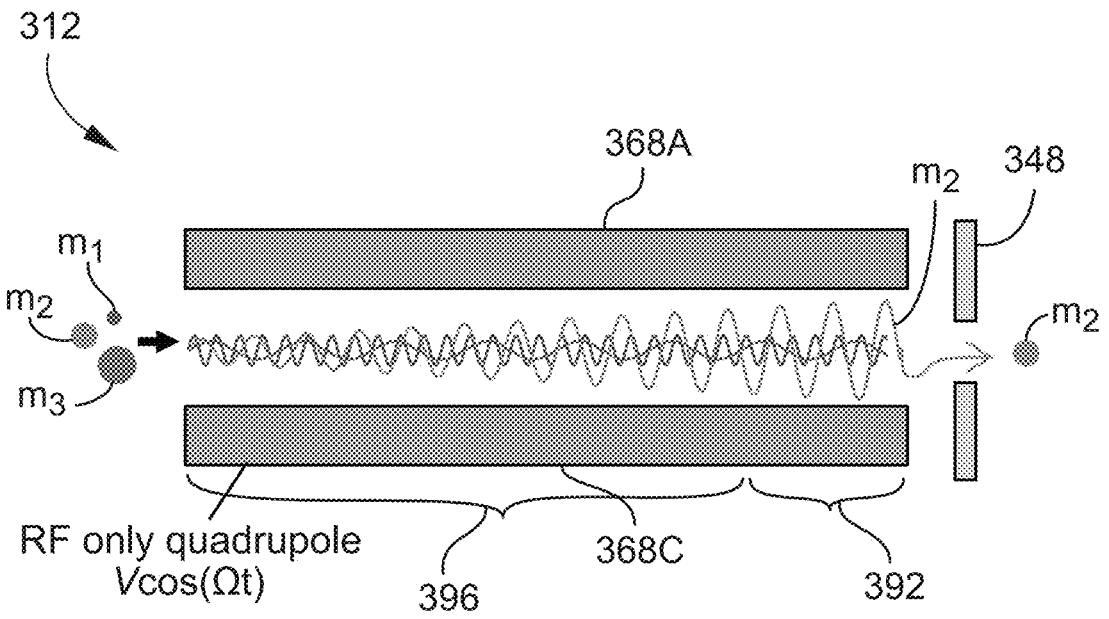
FIG. 3C is a schematic side (lengthwise) view of the quadrupole device illustrated in FIG. 3A, illustrating mass-selective ejection (MSE) of ions by dipole excitation according to an embodiment of the present disclosure.
Figure 3D:
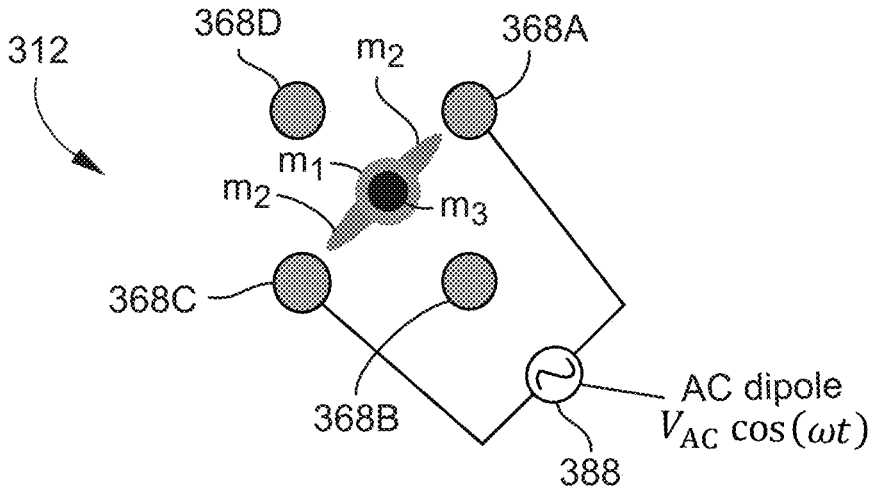
FIG. 3D is a schematic cross-sectional view of the quadrupole device illustrated in FIG. 3C, illustrating MSE by dipole excitation.

FIG. 3C is a schematic side (lengthwise) view and FIG. 3D is a schematic cross-sectional view of the quadrupole device 312 when configured as a LIT and illustrating axial ion ejection by MSE. FIGS. 3C and 3D illustrate the trajectories of different ions in the interior volume of the quadrupole device 312 during the ejection step. For simplicity, ions of only three different masses, $m_1<m_2<m_3$, are depicted. The interior of the quadrupole device 312 may be considered as including a fringing field region 392 surrounded by the axial end portions of the ion guide electrodes 368A, 368B, 368C, and 368D at or near the ion exit and associated ion exit lens 348. In the fringing region 392, electric fringing fields are created due to the presence of truncated electrode geometries (e.g., surfaces). The fringing fields give rise to nonlinearities in the main RF electric field, which causes the radial motion to be coupled with the axial motion of ions subjected to the fringing fields (i.e., in the fringing field region 392). This phenomenon is utilized to effect axial ejection of ions through the ion exit lens 348 by resonant excitation. Specifically, when an ion of a selected mass (in the fringing field region 392) is radially excited by its secular frequency being matched up with the frequency $\omega$ of the applied dipole (or quadrupole) auxiliary AC field described above, this ion will also be axially excited due to the coupling of its radial and axial motion. The resulting increase in the axial kinetic energy of the ion is sufficient to allow the ion to be axially ejected over the (partial) DC potential barrier being applied to the ion exit lens 348, while unexcited ions remain trapped in the quadrupole device 312. As an example, FIGS. 3C and 3D schematically depict this mechanism of axial ejection in the case of ions of mass $m_2$, whose oscillations are increased relative to ions of other masses (e.g., $m_1$ and $m_3$). For further reference, see Qiao et al., Space-charge effect with mass-selective axial ejection from a linear quadrupole ion trap, *Rapid Commun. Mass Spectrom.*, 25, p. 3509-3520 (2011); and U.S. Pat. No. 6,177,668; the contents of each of which are incorporated by reference herein.

In FIG. 3C, a main ion storage region 396 surrounded by the remaining portions of the ion guide electrodes 368A, 368B, 368C, and 368D defines the region in which ions are outside of the of the fringing field region 392 and hence subjected primarily to the main RF electric field such that their axial motions are independent from their radial motions. It will be noted that a similar fringing field may exist at or near the ion entrance end/lens (not shown), which however is not pertinent to the axial ion ejection mechanism occurring at the ion exit lens 348.

Figure 4A:
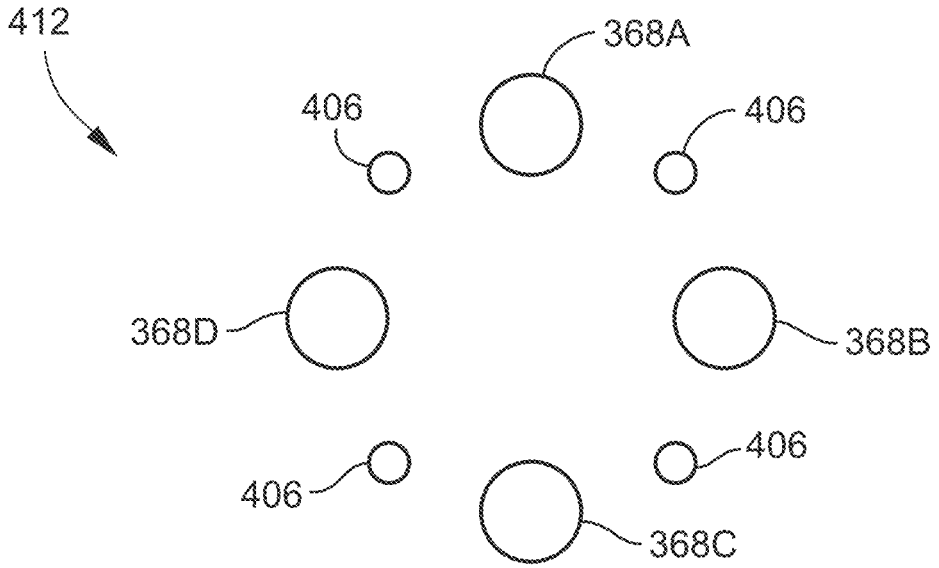
FIG. 4A is a schematic cross-sectional view of a quadrupole device, taken in a transverse plane orthogonal to the ion optical axis of the quadrupole device, according to another embodiment of the present disclosure.

FIG. 4A is a schematic perspective view of an example of a quadrupole device 412 according to another embodiment. The quadrupole device 412 in particular is representative of an embodiment of the LIT 212 described herein, but may also be representative of the first ion guide 256 and/or the second ion guide 260 described herein. The quadrupole device 412 is a modified version of the quadrupole device 312 described above in conjunction with FIGS. 3A and 3B, in which a set of auxiliary electrodes 406 have been added.

In the example specifically illustrated, four auxiliary electrodes 406 are provided and positioned so as to be interdigitated with the ion guide electrodes 368A, 368B, 368C, and 368D. In an embodiment, the auxiliary electrodes 406 may be elongated along the central device axis, and may be tilted toward the central device axis, e.g., tilted toward each other as one moves in the direction from entrance to exit. In an embodiment, the auxiliary electrodes 406 include a layer of electrically resistive material to which an axial DC potential source 410 (FIG. 4B) is coupled. In a typical but not exclusive embodiment, the cross-sections (e.g., diameters) of the auxiliary electrodes 406 are smaller (and may be significantly smaller) than the cross-sections (e.g., diameters) of the ion guide electrodes 368A, 368B, 368C, and 368D.

Figure 4B:
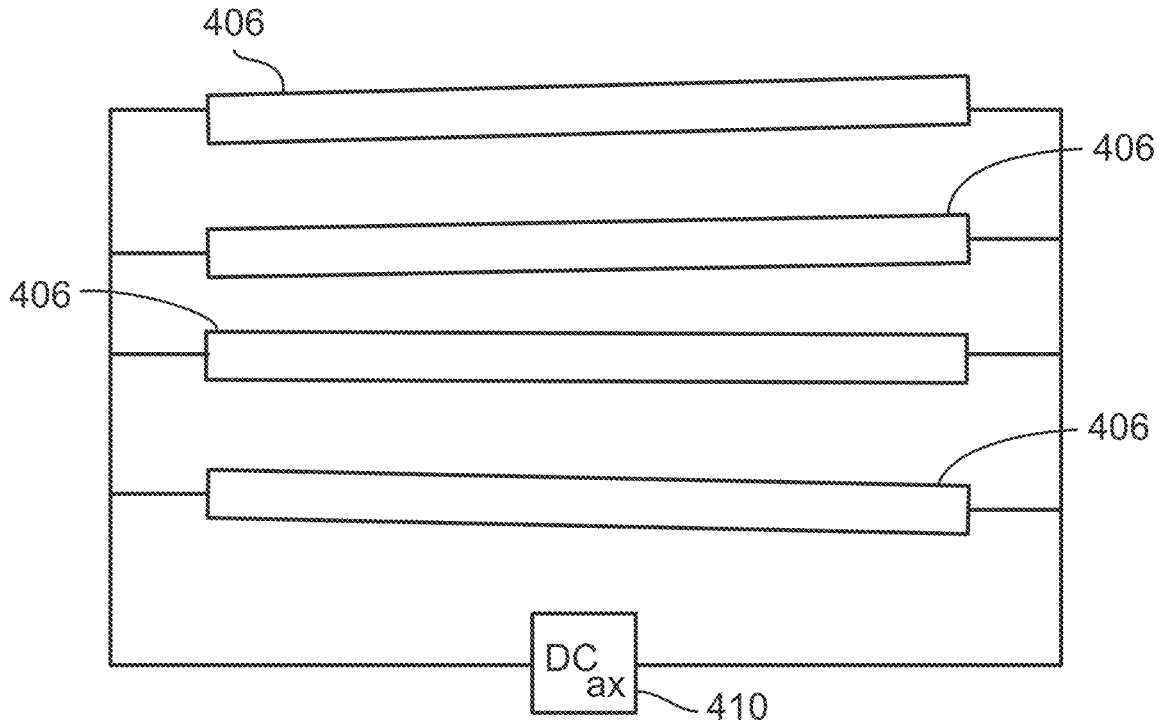
FIG. 4B is a schematic side (lengthwise) view of a set of auxiliary electrodes provided with the quadrupole device illustrated in FIG. 4A.

FIG. 4B is a schematic side (lengthwise) view of the set of auxiliary electrodes 406 provided with the quadrupole device 412. The electrode set is oriented so as to show all four auxiliary electrodes 406. For clarity, the ion guide electrodes 368A, 368B, 368C, and 368D are not shown in FIG. 4B. FIG. 4B also illustrates yet another portion of the power supply/electronics provided with this embodiment of the quadrupole device 412, as schematically represented by an axial DC potential source 410. The axial DC potential source 410 is coupled in parallel with each of the auxiliary electrodes 406, such as by being connected to the two opposing axial ends of each of the auxiliary electrodes 406. The axial DC potential source 410 is configured to apply a DC potential difference (voltage) $DC_{ax}$ across each of the auxiliary electrodes 406 to thereby generate an axial DC potential gradient field in the interior volume of the quadrupole device 412 along its axial length (i.e., from the ion entrance to the ion exit). As noted elsewhere herein, the axial DC potential gradient is useful for providing the ions in the quadrupole device 412 with enough axial kinetic energy to keep them moving forward toward the ion exit during operation of the quadrupole device 412 (particularly in the case of a LIT), and prevent them from escaping through the ion entrance while the ion entrance is open during the ion injection step described herein.

In another embodiment, instead of providing separate auxiliary electrodes 406, the axial DC potential source 410 is coupled to the opposing axial ends of each of the ion guide electrodes 368A, 368B, 368C, and 368D themselves. In this latter case, the ion guide electrodes 368A, 368B, 368C, and 368D may include a layer of electrically resistive material to which the axial DC potential source 410 is coupled. In another embodiment, the ion guide electrodes 368A, 368B, 368C, and 368D and/or the auxiliary electrodes 406 may be axially segmented, and individual DC potentials of successively differing magnitudes are respectively applied to the electrode segments to form the axial DC potential gradient. Devices and methods for generating a DC potential gradient also described in, for example, U.S. Pat. No. 6,111,250, the contents of which are incorporated herein by reference in its entirety.

Figure 5A:
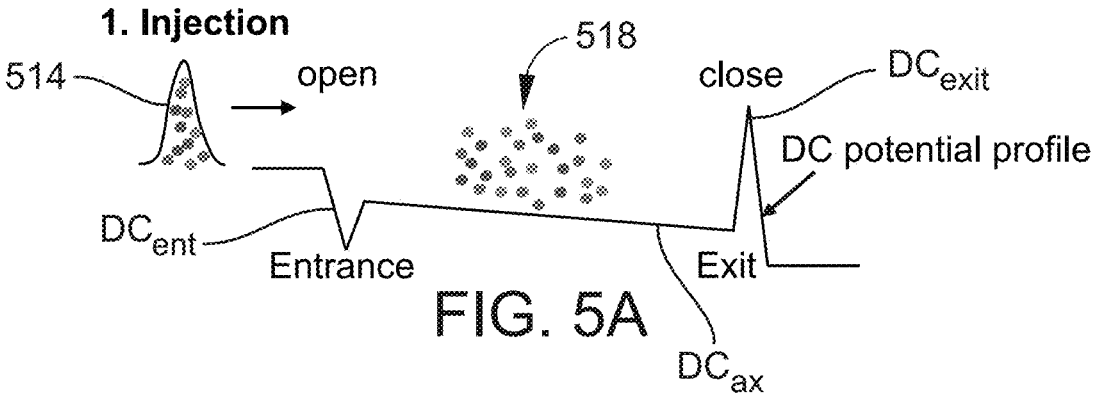
FIG. 5A is a schematic diagram illustrating an ion injection step performed by a linear ion trap (LIT) according to an embodiment of the present disclosure.
Figure 5B:
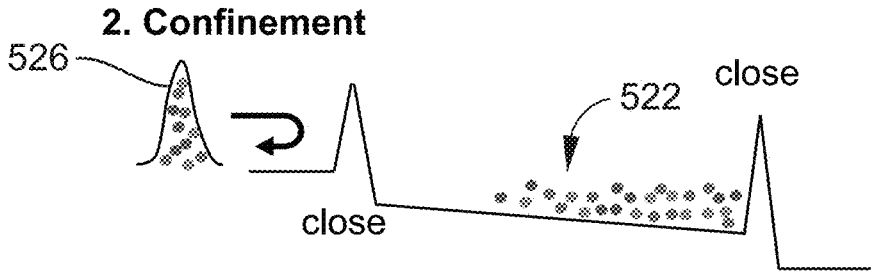
FIG. 5B is a schematic diagram illustrating an ion confinement step performed by the LIT associated with FIG. 5A according to an embodiment of the present disclosure.
Figure 5C:
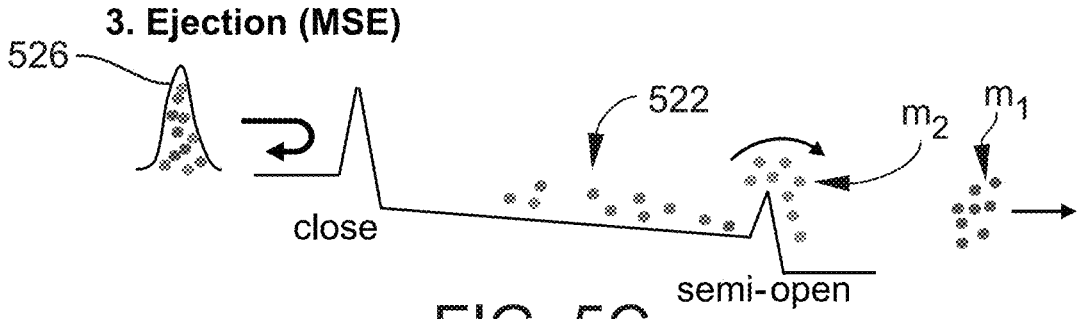
FIG. 5C is a schematic diagram illustrating an ion ejection step performed by the LIT associated with FIG. 5A according to an embodiment of the present disclosure.
Figure 5D:
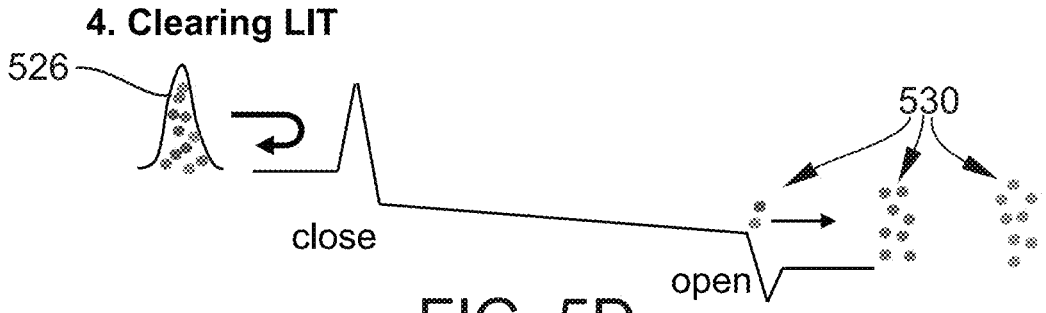
FIG. 5D is a schematic diagram illustrating an ion trap clearing step performed by the LIT associated with FIG. 5A according to an embodiment of the present disclosure.

FIGS. 5A-5D illustrate one cycle of operation of the LIT disclosed herein, such described above and illustrated in FIGS. 3A-3D or additionally in FIGS. 4A-4B. In an embodiment, the LIT implements this operation as part of a method for multi-element analysis by ICP-MS on a sample. Specifically, FIG. 5A illustrates the ion injection step, FIG. 5B illustrates the ion confinement step, FIG. 5C illustrates the ion ejection step, and FIG. 5D illustrates the ion trap clearing step. Each of FIGS. 5A-5D includes a trace representing the DC potential profile according to which the LIT operates during each step of the cycle. The DC potential profile schematically depicts the magnitude of the applied DC potential(s) as a function of axial position, particularly from the ion entrance, along the axial length, and to the ion exit of the LIT. The DC potential profile includes an entrance DC potential $DC_{ent}$ applied at the ion entrance (e.g., to an ion entrance lens) and an exit DC potential $DC_{exit}$ applied at the ion exit (e.g., to an ion exit lens), such as by providing the LIT with the configuration described above in conjunction with FIG. 3A. The DC potential profile also includes an axial DC potential gradient (DC potential difference $DC_{ax}$) applied along the length the LIT, particularly between the ion entrance and the ion exit, such as by providing the LIT with the configuration described above in conjunction with FIGS. 4A-4B.

In the ion injection step (FIG. 5A), an ion pulse 514 is transmitted into the LIT. To enable axial injection, the entrance DC potential $DC_{ent}$ is set to a relatively low magnitude (also referred to herein as a second magnitude of the entrance DC potential $DC_{ent}$) effective to allow the ion pulse 514 to enter the ion trap through the ion entrance. The ions of the ion pulse after entering the LIT are depicted in FIG. 5A as injected ions 518. The exit DC potential $DC_{exit}$ is set to a relatively high magnitude (also referred to herein as a first magnitude of the exit DC potential $DC_{exit}$) to generate a DC potential barrier (i.e., an electrostatic mirror) effective to prevent the ions 518 of the injected ion pulse from exiting the LIT at the ion exit. In other words, during the injection step, the ion entrance is open and the ion exit is closed. The ions that reach the ion exit are reflected by the DC potential barrier, i.e., the ions are blocked by the DC potential barrier and bounced back toward the ion entrance. When the LIT is filled with buffer gas at a sufficient pressure, the ions stagnate in the LIT through multiple collisions with the gas molecules before they make a complete round trip, which could result in the ions escaping the LIT through ion entrance while it is still open. In this way, the injected ions 518 are trapped axially in the LIT during the injection step.

In the ion confinement step (FIG. 5B), both the ion entrance and the ion exit are closed with the injected ions in between, which are depicted in FIG. 5B as confined ions 522. The ion entrance is switched from its open state to a closed state, while the ion exit is kept in its closed state. In the specific example, the entrance DC potential $DC_{ent}$ is switched to a relatively high magnitude (also referred to herein as a first magnitude of the DC potential $DC_{ent}$) to generate a DC potential barrier effective to prevent the ions of the injected ion pulse 514 (the confined ions 522) from exiting the LIT at the ion entrance and prevent other ions outside of the LIT from entering the LIT at the ion entrance. As an example, FIG. 5B illustrates a succeeding ion pulse 526 (following the first ion pulse 514 in the output of the upstream ICP ion source) being reflected by the DC potential barrier at the ion entrance, as depicted by a curved arrow. The exit DC potential $DC_{exit}$ is maintained at its preexisting, relatively high magnitude during the confinement period. During the confinement period, the confined ions 522 are kinetically cooled through collisions with the buffer gas, which is preferable for MSE in the next step as noted above. Also during this period, if needed, unnecessary ions trapped in the LIT may be removed by utilizing, for example, the quadrupole function of notch filtering as described above, which helps to lower the charge density in the LIT.

In the ion ejection step (FIG. 5C), ions of selected masses of the confined ions 522 are ejected successively (e.g., in order of mass) from the LIT by MSE, in particular by the modality of resonant excitation, as described above in conjunction with FIGS. 3C and 3D. Namely, an auxiliary AC electric field is superimposed on the two-dimensional, ion-confining RF electric field, and the RF amplitude $V_{RF}$ (or other appropriate operating parameter of the the frequency of auxiliary AC electric field or RF electric field) is scanned to eject the ions of selected masses from the LIT in mass succession. As a simplified example, FIG. 5C illustrates ions of a first mass $m_1$ being ejected first, followed by ions of a second mass (the next selected mass) $m_2$. In the illustrated example, to facilitate MSE, the exit DC potential $DC_{exit}$ is switched from its high magnitude to an intermediate magnitude (a value between the high and low magnitudes, also referred to herein as a third magnitude of the exit DC potential $DC_{exit}$) to generate an intermediate (or partial) DC potential barrier at the ion exit. In other words, the exit DC potential $DC_{exit}$ is switched from its closed state to a semi-open state. The intermediate magnitude is set to a value that is low enough to allow the currently selected ion, while it is in its excited state, to overcome the intermediate DC potential barrier and pass through the ion exit, yet is high enough to continue to block all other, non-excited ions. The non-excited ions thus remain trapped in the LIT while selected ions are being ejected.

In the ion trap clearing step (FIG. 5D), all ions remaining in the LIT that were not selected for ejection and subsequent measurement (non-selected ions 530) may be removed from the LIT. In the illustrated example, this is accomplished by fully opening the ion exit, i.e., by removing the DC potential barrier that was imposed during the previous injection, confinement, and ejection periods. Specifically, the exit DC potential $DC_{exit}$ is switched from the intermediate magnitude to a relatively low magnitude (also referred to herein as a second magnitude of the exit DC potential $DC_{exit}$) to in effect remove the partial DC potential barrier associated with the intermediate magnitude.

As noted above, the method may include repeating the above-described steps of ion injection, ion confinement, ion ejection (and transmission to an ion detector), and ion trap clearing for one or more additional ion pulses received at the ion entrance of the LIT.

In the present context, the terms "low" magnitude and "high" magnitude as they relate to the entrance DC potential $DC_{ent}$ are relative to each other, i.e., the low magnitude is lower than the high magnitude and the high magnitude is higher than the low magnitude. Likewise, the terms "low" magnitude, "high" magnitude, and "intermediate" magnitude as they relate to the exit DC potential $DC_{exit}$ are relative to each other.

Example 1—Ag/Au Nanoparticles

An ICP-MS system consistent with the embodiments described above in conjunction with FIGS. 1 and 2, in particular having the Q1-LIT-Q2 configuration, was operated in the spICP-LIT-MS mode to trap and mass-analyze Au-core/Ag-shell bimetal nanoparticles (NPs) dispersed in 5% ethanol solution. The NPs were delivered to the ICP ion source sequentially (one by one) to produce ion pulses having sub-millisecond FWHMs, as described herein. The experiment included repeating the four steps of ion injection, ion confinement, ion ejection (and transmission to an ion detector), and ion trap clearing described above. For comparison, a mixture of Au NP suspension and Ag NP suspension was also measured. The buffer gas introduced to the LIT was He for trapping the $Ag^+$ and $Au^+$ ions produced in the ICP ion source. The first quadrupole device Q1 was configured as a mass (bandpass) filter without scanning, and was set to a mass range (passband) from about 100 u to about 200 u so that the $^{107}Ag^+$, $^{109}Ag^+$ and $^{197}Au^+$ isotopes were transmitted to the LIT. The second quadrupole device Q2 was configured as an RF-only ion guide, and was scanned with the LIT during MSE (Step 3) to ensure good ion transmission in this wide mass range. When all three isotopes were measured (mass-selectively ejected), the cycle time was 29.4 ms, including 4 ms of ion injection (Step 1), 2 ms of ion ejection per mass (6 ms for three masses), settling times required for the RF amplitude to jump from one mass to the next, and a few milliseconds for ion confinement (Step 2) and LIT clearing (Step 4). The counts of the ejected ions were registered every cycle, whether or not an NP was trapped. The typical conditions adopted in this experiment are listed in Table 1 below.

Figure 6A:
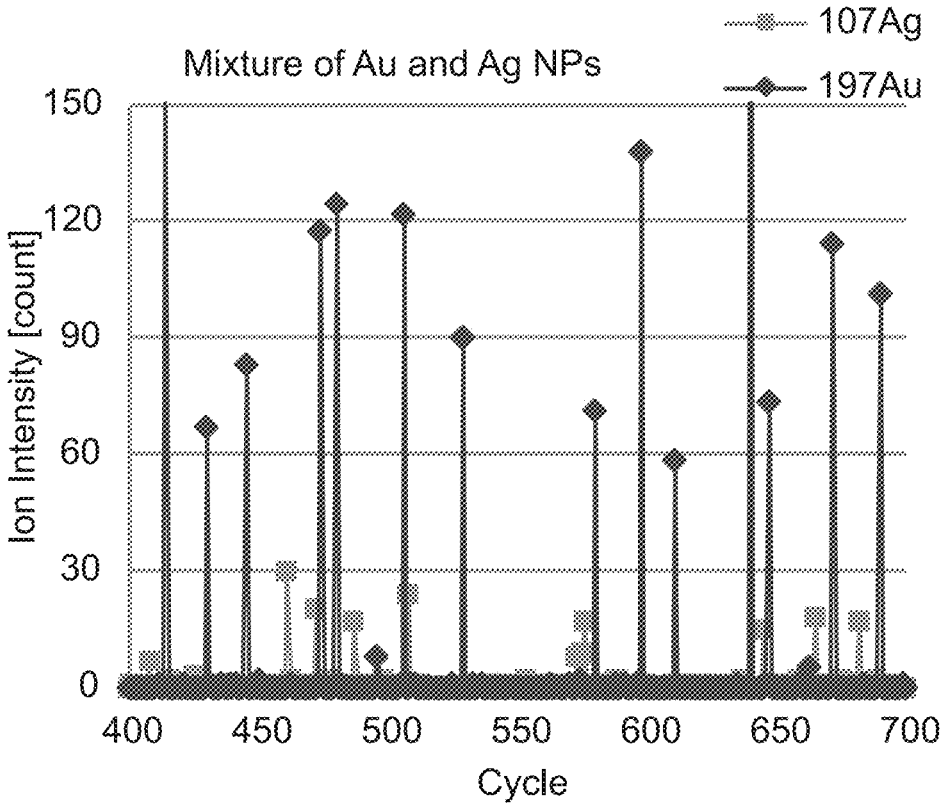
FIG. 6A is a plot of ion intensity (in counts) measured over a number of cycles of operation of a LIT, acquired by performing a multi-element analysis by ICP-MS on a mixture of Au and Ag nanoparticles (NPs) in suspension, according to an embodiment of the present disclosure.
Figure 6B:
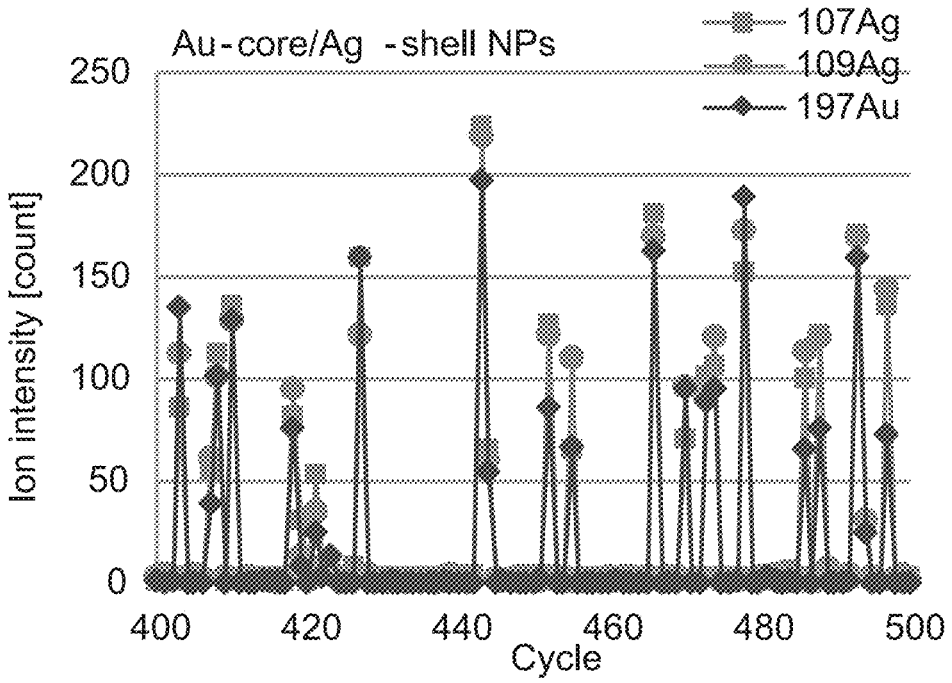
FIG. 6B is a plot of ion intensity (in counts) measured over a number of cycles of operation of a LIT, acquired by performing a multi-element analysis by single-particle ICP-MS on Au-core/Ag-shell NPs, according to an embodiment of the present disclosure.

FIG. 6A shows the measured counts for a certain period of cycles from the analysis of the mixture of Au NP/Ag NP suspension. By comparison, FIG. 6B shows the measured counts for a certain period of cycles from the analysis of the Au-core/Ag-shell NPs. For the mixture suspension of Au and Ag NPs (FIG. 6A), either an Au signal or an Ag signal was recorded when an event was recorded (when a particle was trapped). For the Au-core/Ag-shell bimetal NP suspension (FIG. 6B), both Au and Ag counts were always recorded whenever an event was recorded, indicating that the Au and Ag signals detected at each event were derived from the same single particle. From the Au and Ag signal intensities measured for the particle, the volumes of the Au core and the Ag shell of the particle are obtained. Thus, size characterization (core diameter and shell thickness) is possible for each Au-core/Ag-shell nanoparticle. By contrast, in the standard spICP-MS analysis by ICP-QMS, the Ag shell thickness cannot be measured because of the lack of correlation between Au and Ag signals (Au and Ag volumes) for the same particle, and only the Au core diameter can be measured for each particle.

Example 2—Yeast Cells

An ICP-MS system consistent with the embodiments described above in conjunction with FIGS. 1 and 2, in particular having the Q1-LIT-Q2 configuration, was utilized to perform a multi-element biological cell analysis. Specifically, the ICP-MS system was operated in the scICP-LIT-MS mode to trap and mass-analyze yeast cells dispersed in 5% ethanol solution. The yeast cells were delivered to the ICP ion source sequentially (one by one) to produce ion pulses having sub-millisecond FWHMs, as described herein. The experiment included repeating the four steps of ion injection, ion confinement, ion ejection (and transmission to an ion detector), and ion trap clearing described above. The buffer gas introduced to the LIT was a mixture of the reactive gases $H_2$ and $O_2$ with He buffer gas to detect spectrally interfered elements (e.g., P, S, Ca, Fe) with a reduced charge density. The first quadrupole device Q1 was configured as a mass (bandpass) filter without scanning, and was set to a mass range (passband) from about 30 u to about 70 u so that the ionized elements of interest in this experiment—P, S, Ca, Fe and Zn—were allowed to be transmitted to the LIT. The second quadrupole device Q2 was configured initially as an RF-only ion guide, and subsequently as a mass filter to obtain better results, as described further below. The typical conditions adopted in this experiment are listed in Table 1 below.

In this experiment, in addition to the analyte ions (e.g., P, S, Ca, Fe ions), the plasma-based ions in the mass range (about 30 u to about 70 u) to which the mass filter Q1 is tuned—e.g., $O_2^+$, $Ar^+$, $ArH^+$, $ArO^+$, etc.—are transmitted through the mass filter Q1 and into the LIT as well. During the ion injection period of 5 ms, these intense plasma-based ions continuously flow into the LIT and raise the charge density in ion-trapping volume of the LIT. The plasma-based ions will preclude MSE if no measures are taken to address their presence in the LIT. Indeed, it was found that the MSE operation did not provide any spectral peak if no measure was taken against these plasma-based ions. Notch filtering cannot be utilized because such technique will also filter out the $^{32}S^+$ ions together with the $^{16}O_2^+$ ions, and the $^{40}Ca^+$ ions together with the $^{40}Ar^+$ ions.

To address this problem, the LIT was also operated as a reaction cell as well as an ion trap. Specifically, the LIT was filled with a gas mixture of reactive gases, $H_2$ and $O_2$, and He buffer gas, and the plasma-based ions were chemically reduced by reacting with the reactive gases. Through the charge transfer reaction (A), the H-atom transfer reaction (B), and the proton transfer reaction (C), $H_2$ gas converts $Ar^+$ and $ArH^+$ to $H_2^+$ and $H_3^+$, respectively, as follows:

$$Ar^+ + H_2 \rightarrow Ar^+H_2^+ \quad (A)$$

$$Ar^+ + H_2 \rightarrow ArH^+ + H \quad (B)$$

$$ArH^+ + H_2 \rightarrow Ar + H_3^+ \quad (C)$$

$$H_2^+ + H_2 \rightarrow H_3^+ + H \quad (B)$$

If the low mass cut-off of the LIT quadrupole is set above 3 u but below 40 u, the low mass products, the $H_2^+$ and $H_3^+$ ions fall outside of the stability region of the LIT quadrupole, and thus are radially ejected by the RF electric field, while the $^{40}Ca^+$ ions are kept confined in the LIT. In this way, the space charge density stemming from $Ar^+$ and $ArH^+$ was eliminated during the injection and confinement periods.

For Fe detection with a reduced charge density, the interfering $ArO^+$ ions can also be eliminated by the same technique if the low mass cut-off is set above 19 u to reject $H_2O^+$ and $H_3O^+$. The chemical reactions involved are as follows:

$$ArO^+ + H_2 \rightarrow ArOH^+ + H$$

$$ArO^+ + H_2 \rightarrow Ar + H_2O^+$$

$$H_2O^+ + H_2 \rightarrow H_3O^+ + H$$

This technique, however, cannot be applied to $O_2^+$ ion elimination, because the $O_2^+$ ion is apparently unreactive. But the interfered $S^+$ ion is reactive with $O_2$ gas. The $S^+$ ion is converted to $SO^+$ product ion through the O-atom transfer reaction with $O_2$ gas. The chemical reactions involved are as follows:

$$O_2^+ + H_2 \rightarrow O_2^+ + H_2 \text{ (no products having mass of 48 u)}$$

$$O_2^+ + O_2 \rightarrow O_2^+ + O_2 \text{ (no products having mass of 48 u)}$$

$$S^+ + O_2 \rightarrow SO^+ + O$$

Then, the $^{16}O_2^+$ ions (32 u) are selectively rejected while retaining $^{32}S^{16}O^+$ (48 u) in the LIT by increasing the low mass cut-off to a mass higher than 32 u, but lower than 48 u during the confinement period. Sulphur is therefore detected by MSE of the $SO^+$ ions from the LIT with a reduced charge density.

The same technique may be implemented for the detection of P as $PO^+$ (47 u) by MSE, where the isobaric interferences $^{15}N^{16}O^+$ and $^{14}N^{16}OH^+$ do not react with $O_2$ gas to form any product ions that interfere with $PO^+$. The chemical reactions involved are as follows:

$$NO_2^+ + O_2 \rightarrow \text{no products having mass of 47 u}$$

$$NOH^+ + O_2 \rightarrow \text{no products having mass of 47 u}$$

$$P^+ + O_2 \rightarrow PO^+ + O$$

By implementing the foregoing technique as part of the operation of the LIT, both charge density and isobaric interferences are reduced simultaneously.

For the yeast cell analysis of this Example, the low mass cut-off was set to about 35 u before executing MSE, and MSE was executed for $^{40}Ca^+$, $^{31}P^{16}O^+$, $^{32}S^{16}O^+$, $^{56}Fe^+$ and $^{64}Zn^+$ ions with a reduced charge density in the LIT and reduced isobaric interferences.

Figure 7A:
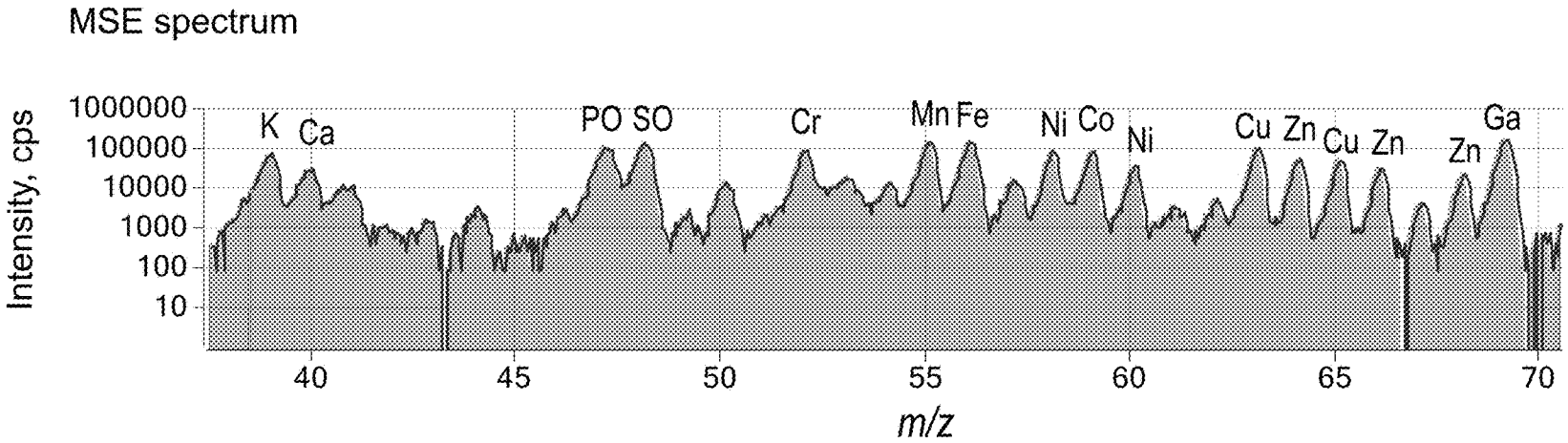
FIG. 7A is an MSE spectrum acquired by performing a multi-element analysis on a multi-element standard solution, by operating the ICP-MS system illustrated in FIG. 2 with the Q2 device operated as an RF-only ion guide, according to an embodiment of the present disclosure.

FIG. 7A is an MSE spectrum measured from carrying out the above-described analysis on a multi-element standard solution (P and S at 100 ppb, other elements at 1 ppb) with the second quadrupole device Q2 operated as an RF-only ion guide. As evident, the MSE spectrum was still poor in terms of peak shape (or abundance sensitivity). The poor peak shape was found to improve significantly when $O_2$ gas was turned off although, consequently, $PO^+$ and $SO^+$ were not detected. This result indicates that the space charge density was suppressed enough to execute MSE, but the $O_2$ gas degraded the spectrum, which may be due to the $O_2$ molecules being too heavy for MSE of the light atomic ions.

Figure 7B:
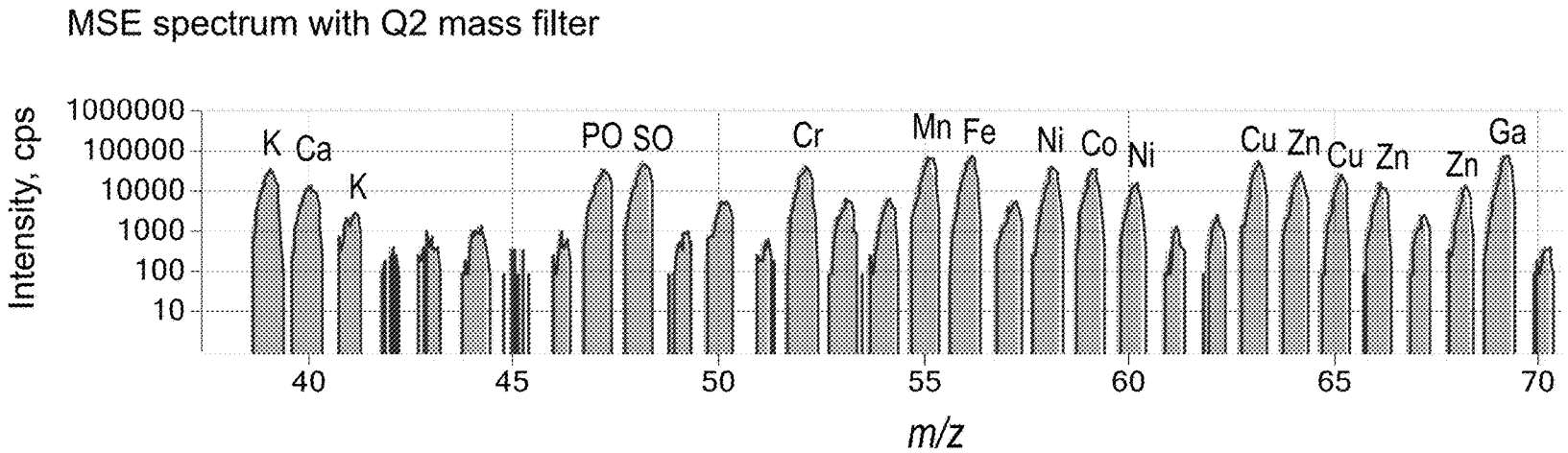
FIG. 7B is an MSE spectrum acquired by performing a multi-element analysis on a multi-element standard solution, by operating the ICP-MS system illustrated in FIG. 2 with the Q2 device operated as a mass filter with mass scanning of ions ejected by MSE from the LIT.

To address this problem and implement multi-element single cell ICP-MS with sufficient mass resolution while utilizing the $H_2$—$O_2$—He mixture gas, the second quadrupole device Q2 was operated as a mass filter at unit mass resolution, and scanned with the LIT keeping the mass of the ion filtered by the second quadrupole device Q2 the same as that of the ion ejected from the LIT by MSE. As a result, the MSE spectrum was reshaped as shown in FIG. 7B. As evident from comparing the MSE spectra in FIGS. 7A and 7B, the quality of the reshaped MSE spectrum of FIG. 7B was significantly higher when the second quadrupole device Q2 was operated as a mass filter with scanning coordinated with the MSE carried out by the LIT.

Figure 8B:
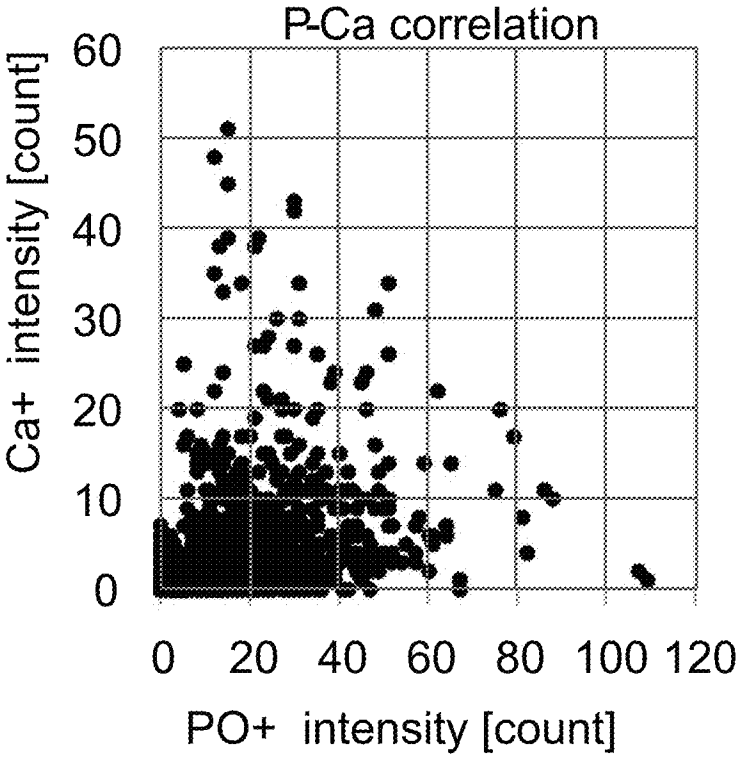
FIG. 8B is a plot of $PO^+$ ion intensity (in counts) versus $Ca^+$ ion intensity (in counts), showing P—Ca correlation, acquired by performing a multi-element analysis by single-cell ICP-MS on yeast cells, according to an embodiment of the present disclosure.
Figure 8A:
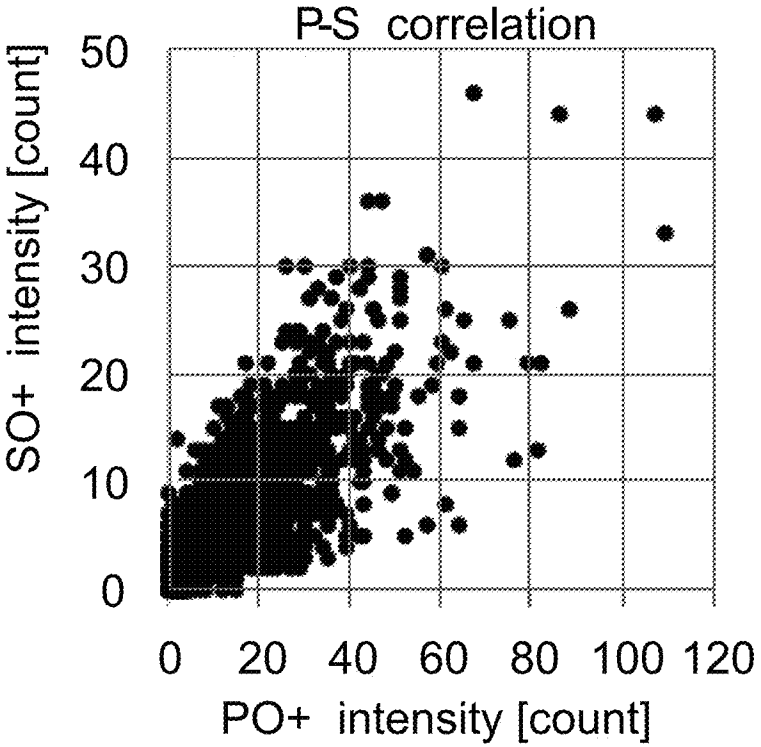
FIG. 8A is a plot of $PO^+$ ion intensity (in counts) versus $SO^+$ ion intensity (in counts), showing P—S correlation, acquired by performing a multi-element analysis by single-cell ICP-MS on yeast cells, according to an embodiment of the present disclosure.
Figure 8D:
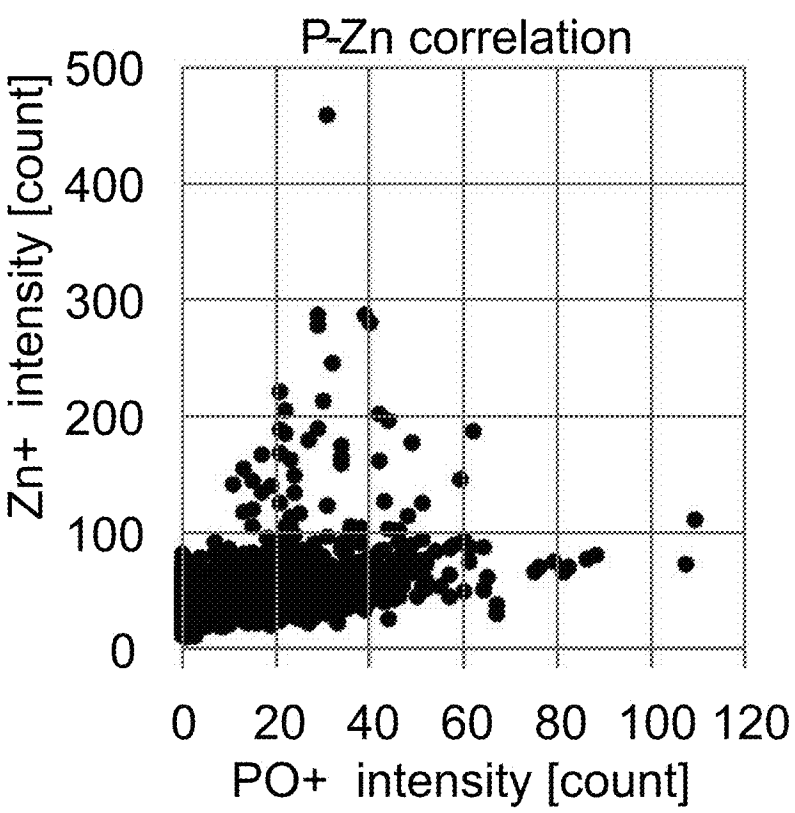
FIG. 8D is a plot of $PO^+$ ion intensity (in counts) versus $Zn^+$ ion intensity (in counts), showing P—Zn correlation, acquired by performing a multi-element analysis by single-cell ICP-MS on yeast cells, according to an embodiment of the present disclosure.
Figure 8C:
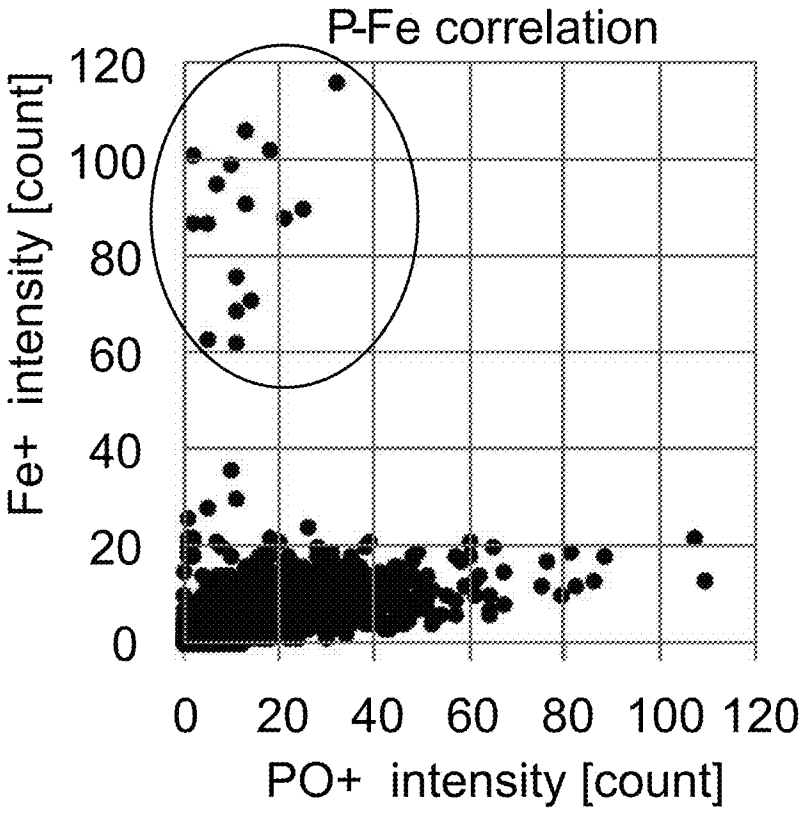
FIG. 8C is a plot of $PO^+$ ion intensity (in counts) versus $Fe^+$ ion intensity (in counts), showing P—Fe correlation, acquired by performing a multi-element analysis by single-cell ICP-MS on yeast cells, according to an embodiment of the present disclosure.

Under the foregoing measurement conditions, multi-element detection was conducted for individual yeast cells in the scICP-MS mode. The LIT and the second quadrupole device Q2 peak-hopped at masses of 40 u, 47 u, 48 u, 56 u, and 64 u with a cycle time of 32.9 ms for the detection of Ca, P, S, Fe and Zn elements, respectively. The duty cycle was 15.2% (the injection time was 5 ms), but the five elements were measured per cycle. As in the case with Au/Ag NPs, the signals of multiple elements were recorded whenever an event was recorded (a cell was trapped). By repeating the four steps of ion injection, ion confinement, ion ejection, and ion trap clearing described above, nearly 1000 cells were trapped and mass-analyzed. Most often, the P signal ($PO^+$ intensity) was the highest of all signals. Elemental correlations (P—S, P—Ca, PFe, and P—Zn correlations) were examined using scatterplots with the P signal intensity on x-axis, as shown in FIGS. 8A-8D respectively. A positive correlation was clearly observed between P and S (FIG. 8A), while Ca seemed to have a rather negative correlation with P (FIG. 8B). Fe also had a positive correlation with P (FIG. 8C), but some yeast cells have relatively very large amounts of Fe, compared with the P amounts (shown in the circle in FIG. 8C), which can be distinguished as a specific group. Although a detailed interpretation of the correlation analyses shown in FIGS. 8A-8D is outside the scope of the present disclosure, FIGS. 8A-8D demonstrate that multi-elemental information was successfully acquired from individual cells by the system and method of the present disclosure.

TABLE 1

| Typical operating conditions of LIT | |
|---|---|
| Radio frequency of main voltage Ω | 2.8 MHz |
| Amplitude of the main voltage $V_{RF}$ | Scanned within the range from 10 V to 1200 V |
| Frequency of the auxiliary voltage ω | 0.8 MHz or 1 MHz |
| Amplitude of the auxiliary voltage $V_{AC}$ | 2 V (peak-to-peak) |
| Buffer gas and reaction gas | He: 9-12 sccm (nanoparticles)<br>He: 9 sccm + $O_2$: 0.75 sccm + $H_2$: 1 sccm (yeast cells) |
| Axial field in LIT | 20 V/m |
| DC potential of quadrupole | −10 V |
| Field radius of quadrupole $R_o$ | 3.18 mm |
| Exit lens potential $DC_{exit}$ | −7 V(intermediate magnitude) |

In conventional quadrupole ICP-MS systems, it has not been possible to perform multi-element analysis of transient signals such as those produced in the analysis of single samples (e.g., nanoparticles or other single particles, single biological cells, or clouds of aerosolized sample material such as created in high-speed laser ablation ICP-MS imaging). For such applications, ICP-TOF-MS and ICP-MC-SF-MS systems typically have been employed. According to the present disclosure, however, the integration of an ion trap with an ICP-MS, such as a LIT operating in concert with Q1 and/or Q2 quadrupole devices in an ICP double or triple quadrupole system, provides an ICP-MS system capable of effectively and efficiently performing multi-element analysis of transient signals. Moreover, the ion trap may also be operated as a reaction cell to provide the capability to perform effective interference removal, thereby enabling the detection of interfered elements from transient signals, which conventional systems such as ICP-TOF-MS and ICP-MC-SF-MS are not able to do.

Figure 9:
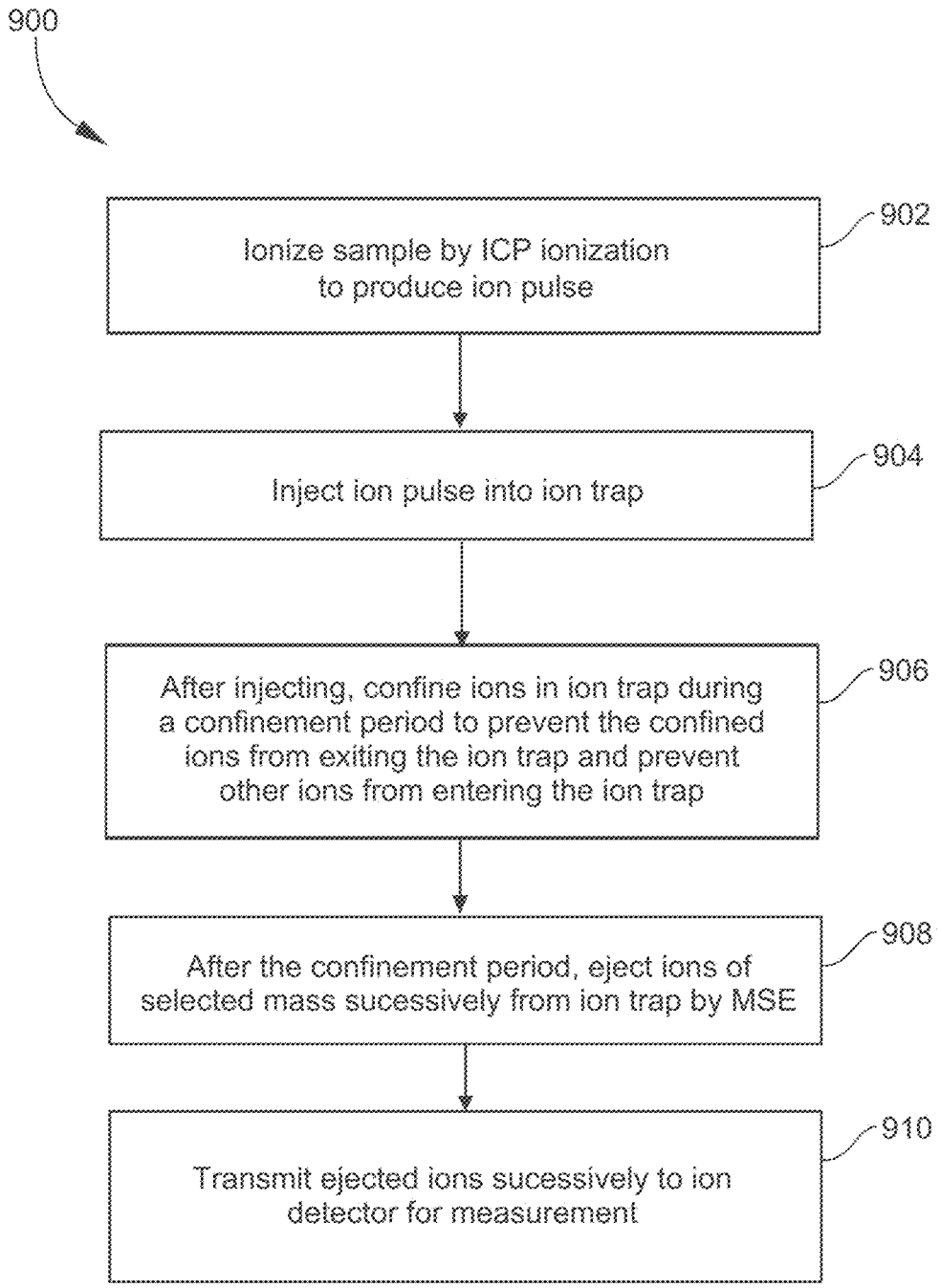
FIG. 9 is a flow diagram illustrating an example of a method for multi-element analysis by inductively coupled plasma-mass spectrometry (ICP-MS), according to an embodiment of the present disclosure.

FIG. 9 is a flow diagram 900 illustrating an example of a method for multi-element analysis by inductively coupled plasma-mass spectrometry (ICP-MS) according to an embodiment. A sample is ionized a sample by ICP ionization to produce an ion pulse (step 902), which has a plurality of ions having two or more different masses. The ion pulse is injected into an ion trap (step 904). After the injecting, the ions of the injected ion pulse are confined in the ion trap during a confinement period (step 906), during which the confining prevents the confined ions from exiting the ion trap and prevents other ions outside of the ion trap from entering the ion trap. After the confinement period, ions of selected masses of the confined ions are ejected successively from the ion trap by mass-selective ejection (MSE) (step 908). The ejected ions are then transmitted successively to an ion detector for measurement (step 910).

In an embodiment, the flow diagram 900 may represent an ICP-MS system (or portion thereof) configured to carry out steps 902-910. For this purpose, a controller (e.g., the controller 128 shown in FIG. 1) including a processor, memory, and other components as appreciated by persons skilled in the art, may be provided to control the performance of steps 902-910, such as by controlling the components (e.g., ion trap, electronics, etc.) of the ICP-MS system involved in carrying out steps 902-910.

Figure 10:
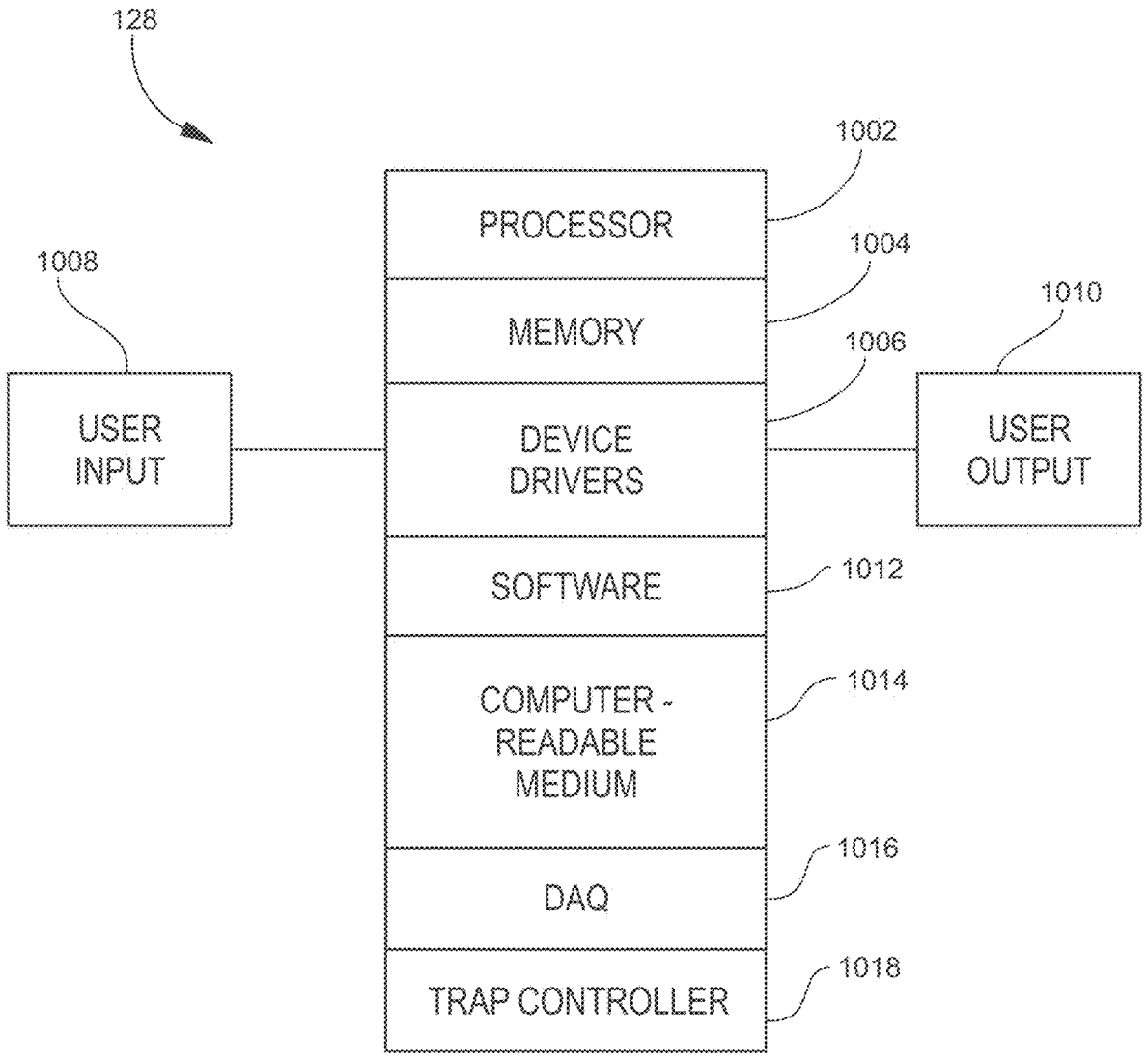
FIG. 10 is a schematic view of an example of a system controller (or controller, or computing device) that may be part of or communicate with a spectrometry system such as the ICP-MS system, according to an embodiment of the present disclosure.

FIG. 10 is a schematic view of a non-limiting example of the system controller (or controller, or computing device) 128 that may be part of or communicate with a spectrometry system such as the ICP-MS system 100 or 200 illustrated in FIG. 1 or FIG. 2. In the illustrated embodiment, the system controller 128 includes a processor 1002 (typically electronics-based), which may be representative of a main electronic processor providing overall control, and one or more electronic processors configured for dedicated control operations or specific signal processing tasks (e.g., a graphics processing unit or GPU, a digital signal processor or DSP, an application-specific integrated circuit or ASIC, a field-programmable gate array or FPGA, etc.). The system controller 128 also includes one or more memories 1004 (volatile and/or non-volatile) for storing data and/or software. The system controller 128 may also include one or more device drivers 1006 for controlling one or more types of user interface devices and providing an interface between the user interface devices and components of the system controller 128 communicating with the user interface devices. Such user interface devices may include user input devices 1008 (e.g., keyboard, keypad, touch screen, mouse, joystick, trackball, and the like) and user output devices 1010 (e.g., display screen, printer, visual indicators or alerts, audible indicators or alerts, and the like). In various embodiments, the system controller 128 may be considered as including one or more of the user input devices 1008 and/or user output devices 1010, or at least as communicating with them. The system controller 128 may also include one or more types of computer programs or software 1012 contained in memory and/or on one or more types of computer-readable media 1014. The computer programs or software may contain non-transitory instructions (e.g., logic instructions) for controlling or performing various operations of the ICP-MS system 100. The computer programs or software may include application software and system software. System software may include an operating system (e.g., a Microsoft Windows® operating system) for controlling and managing various functions of the system controller 128, including interaction between hardware and application software. In particular, the operating system may provide a graphical user interface (GUI) displayable via a user output device 1010, and with which a user may interact with the use of a user input device 1008. The system controller 128 may also include one or more data acquisition/signal conditioning components (DAQs) 1016 (as may be embodied in hardware, firmware and/or software) for receiving and processing ion measurement signals outputted by the ion detector 161 or 216 (FIG. 1 or 2), including formatting data for presentation in graphical form by the GUI.

The system controller 128 may further include an ion trap controller (or control module) 1018 configured to control the operation of the ion trap 112 or 212 (according to any of the embodiments described herein) and coordinate and/or synchronize the ion trap operation with the operations one or more other components of the ICP-MS system 100 or 200 illustrated in FIG. 1 or 2 (e.g., ion source 108 or 208, ion detector 116 or 216, ICP power source 120, ion trap power source 124, other electronics, quadrupole devices 256 and 260, etc.). Thus, the ion trap controller 1018 may be configured to control or perform all or part of any of the methods disclosed herein, including methods for operating the ion trap 112 or 212. For these purposes, the ion trap controller 1018 may be embodied in software and/or electronics (hardware and/or firmware) as appreciated by persons skilled in the art.

It will be understood that FIG. 10 is high-level schematic depiction of an example of a system controller 128 consistent with the present disclosure. Other components, such as additional structures, devices, electronics, and computer-related or electronic processor-related components may be included as needed for practical implementations. It will also be understood that the system controller 128 is schematically represented in FIG. 10 as functional blocks intended to represent structures (e.g., circuitries, mechanisms, hardware, firmware, software, etc.) that may be provided. The various functional blocks and any signal links between them have been arbitrarily located for purposes of illustration only and are not limiting in any manner Persons skilled in the art will appreciate that, in practice, the functions of the system controller 128 may be implemented in a variety of ways and not necessarily in the exact manner illustrated in FIG. 10 and described by example herein.

Exemplary Embodiments

Exemplary embodiments provided in accordance with the presently disclosed subject matter include, but are not limited to, the following:

1. A method for multi-element analysis by inductively coupled plasma-mass spectrometry (ICP-MS), the method comprising: ionizing a sample by ICP ionization to produce an ion pulse comprising a plurality of ions having two or more different masses; injecting the ion pulse into an ion trap; after the injecting, confining the ions of the injected ion pulse in the ion trap during a confinement period, during which the confining prevents the confined ions from exiting the ion trap and prevents other ions outside of the ion trap from entering the ion trap; after the confinement period, ejecting ions of selected masses of the confined ions mass-successively from the ion trap by mass-selective ejection (MSE); and transmitting the ejected ions mass-successively to an ion detector for measurement.

2. The method of embodiment 1, wherein the sample is selected from the group consisting of: a single particle; a single biological cell; an aerosol cloud; and an aerosol cloud produced by laser ablation of a material.

3. The method of any of the preceding embodiments, wherein the ions of the injected ion pulse comprises analyte ions and interfering ions.

4. The method of embodiment 3, wherein the interfering ions are selected from the group consisting of: positive argon ions; polyatomic ions containing argon; doubly-charged ions containing a component of the sample; isobaric ions containing a component of the sample; and polyatomic ions containing a component of the sample.

5. The method of any of the preceding embodiments, wherein the ejected ions are selected from the group consisting of: positive monatomic ions of a metal or other element except for a rare gas; and product ions produced by reacting a reaction gas in the ion trap with positive monatomic ions of a metal or other element except for a rare gas.

6. The method of any of the preceding embodiments, wherein the ionizing the sample comprises operating a plasma torch.

7. The method of embodiment 6, comprising flowing the sample into the plasma torch from a sample source selected from the group consisting of a nebulizer; a spray chamber; a particle injector; and a laser ablation cell.

8. The method of any of the preceding embodiments, comprising removing from the ion trap the confined ions that remained in the ion trap after completing the ejecting by MSE.

9. The method of any of the preceding embodiments, wherein: the ion trap comprises an entrance and an exit; the injecting comprises applying an exit DC potential at the exit at a first exit DC potential magnitude to generate a DC potential barrier effective to prevent the ions of the injected ion pulse from exiting the ion trap at the exit; the confining comprises applying an entrance DC potential at the entrance at a first entrance DC potential magnitude to generate a DC potential barrier effective to prevent the ions of the injected ion pulse from exiting the ion trap at the entrance and prevent other ions outside of the ion trap from entering the ion trap at the entrance, while maintaining the exit DC potential at the first exit DC potential magnitude; and the ejecting comprises switching the exit DC potential to a second exit DC potential magnitude lower than the first exit DC potential magnitude, to generate a partial DC potential barrier effective to allow the mass-selected ions to exit the ion trap through the exit by mass-selective ejection while preventing ions of non-selected masses of the confined ions from exiting the ion trap at the exit.

10. The method of embodiment 9, wherein the injecting comprises switching the entrance DC potential from the first entrance DC potential magnitude to a second entrance DC potential magnitude lower than the first entrance DC potential magnitude, wherein the second entrance DC potential magnitude is effective to allow the ion pulse to enter the ion trap through the entrance.

11. The method of embodiment 9 or 10, wherein the applying the exit DC potential comprises applying the exit DC potential at an exit lens of the ion trap, and the applying the entrance DC potential comprises applying the entrance DC potential at an entrance lens of the ion trap.

12. The method of any of embodiments 9-11, comprising removing residual ions of the confined ions that remained in the ion trap after completing the ejecting by MSE, by switching the exit DC potential to a third exit DC potential magnitude lower than the second exit DC potential magnitude, wherein the exit DC potential magnitude is effective to allow the residual ions to exit the ion trap through the exit.

13. The method of any of the preceding embodiments, comprising generating a radio-frequency (RF) electric field in the ion trap to limit radial excursions of the injected ions away from a central region or axis of the ion trap during the injecting, the confining and the ejecting.

14. The method of embodiment 13, wherein the ion trap comprises a plurality of guide electrodes defining a linear ion trap (LIT), and the generating the RF electric field comprises applying RF potentials to the guide electrodes.

15. The method of embodiment 14, comprising applying an axial DC potential gradient along the LIT to urge the injected ions in a direction toward the exit during the injecting, the confining and the ejecting.

16. The method of embodiment 15, wherein the LIT comprises an entrance and an exit respectively located at opposing axial ends of the ion guide electrodes, and the ejecting comprises axially ejecting the ions of selected masses through the exit.

17. The method of any of embodiments 13-16, wherein the ejecting comprises superimposing an auxiliary alternating-current (AC) electric field on the RF electric field, and scanning an operating parameter of at least one of the auxiliary AC electric field or the RF electric field to eject the ions of selected masses by resonant excitation.

18. The method of embodiment 17, wherein: the ion trap comprises a plurality of guide electrodes defining a linear ion trap (LIT), and the generating the RF electric field comprises applying RF potentials to the guide electrodes; and the ejecting comprises applying the alternating-current (AC) potential to at least one opposing pair of the guide electrodes to generate the auxiliary AC electric field.

19. The method of embodiment 18, wherein the LIT comprises an entrance and an exit respectively located at opposing axial ends of the ion guide electrodes, and the ejecting comprises axially ejecting the ions of selected masses through the exit.

20. The method of any of the preceding embodiments, wherein the injecting comprises transmitting ions of the ion pulse from a quadrupole mass filter, and the transmitted ions are within a mass range set by the mass filter.

21. The method of any of the preceding embodiments, wherein the transmitting the ejected ions comprises transmitting the ejected ions through a quadrupole device positioned between the ion trap and the ion detector, and operating the quadrupole device as an RF-only ion guide or a mass filter.

22. The method of embodiment 21, wherein the operating the quadrupole device comprises scanning the quadrupole device at unit mass resolution in accordance with the mass-selective ejection, such that the ions of selected masses are ejected by the ion trap and filtered by the quadrupole device filter on the same mass-selective basis.

23. The method of any of the preceding embodiments, comprising flowing a buffer gas into the ion trap to kinetically cool the ions of the injected ion pulse during the injecting and the confining.

24. The method of embodiment 23, wherein the buffer gas is selected from the group consisting of: hydrogen; helium; nitrogen; neon; and a combination of two or more of the foregoing 25. The method of any of the preceding embodiments, comprising flowing a reaction gas into the ion trap and reacting the reaction gas with one or more of the injected ions during the confinement period, wherein the reacting is effective to suppress interfering ion signal intensity as measured by the ion detector.

26. The method of embodiment 25, wherein the reaction gas is selected from the group consisting of: hydrogen; oxygen; water; air; ammonia; methane; fluoromethane; nitrous oxide; and a combination of two or more of the foregoing.

27. The method of any of the preceding embodiments, comprising: sequentially transmitting one or more additional ion pulses to the ion trap; and repeating the steps of injecting, confining, ejecting, and transmitting to the ion detector for the one or more additional ion pulses.

28. The method of any of the preceding embodiments, comprising delivering a plurality of single samples to an ICP, wherein: the ionizing comprises ionizing the single samples sequentially to produce a plurality of ion pulses, respectively; and the ion pulse injected into the ion trap is one of the plurality of ion pulses.

29. An inductively coupled plasma-mass spectrometry (ICP-MS) system, comprising: an ion source configured to receive successive single samples, generate plasma, and produce respective ion pulses in the plasma from the successive single samples; the ion trap of any of the preceding embodiments; and a controller comprising an electronic processor and a memory, and configured to control the steps of the method of any of the preceding embodiments to analyze one or more of the ion pulses.

30. An inductively coupled plasma-mass spectrometry (ICP-MS) system, comprising: an ion source configured to receive successive single samples, generate plasma, and produce respective ion pulses in the plasma from the successive single samples; an ion trap; an ion detector; and a controller comprising an electronic processor and a memory, and configured to control an operation comprising: producing an ion pulse in the ion source comprising a plurality of ions having two or more different masses; injecting the ion pulse into the ion trap; after the injecting, confining the ions of the injected ion pulse in the ion trap during a confinement period, during which the confining prevents the confined ions from exiting the ion trap and prevents other ions outside of the ion trap from entering the ion trap; after the confinement period, ejecting ions of selected masses of the confined ions mass-successively from the ion trap by mass-selective ejection; and transmitting the ejected ions mass-successively to the ion detector for measurement.

31. The ICP-MS system of embodiment 30, comprising a quadrupole ion guide positioned between the ion source and the ion trap, and configured to operate as an RF-only ion guide or as a mass filter.

32. The ICP-MS system of embodiment 30 or 31, comprising a quadrupole ion guide positioned between the ion trap and the ion detector, and configured to operate as an RF-only ion guide or as a mass filter.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the controller 128 schematically depicted in FIG. 1. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), field-programmable gate arrays (FPGAs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the controller 128 in FIG. 1), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD- RW (optical); and digital versatile disc memory, i.e., DVD (optical). Note that the non-transitory computer-readable storage medium may even be paper or another suitable medium upon which the program is printed, as the program may be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for multi-element analysis by inductively coupled plasma-mass spectrometry (ICP-MS), the method comprising:

delivering a plurality of single samples to an ICP ion source;

ionizing the single samples sequentially by ICP ionization to produce a plurality of ion pulses, respectively, wherein at least one ion pulse of the plurality of ion pulses comprises a plurality of ions having two or more different masses;

injecting the at least one ion pulse into an ion trap;

after the injecting, confining the ions of the injected ion pulse in the ion trap during a confinement period, during which the confining prevents the confined ions from exiting the ion trap and prevents other ions outside of the ion trap from entering the ion trap;

after the confinement period, ejecting ions of selected masses of the confined ions mass-successively from the ion trap by mass-selective ejection (MSE); and transmitting the ejected ions mass-successively to an ion detector for measurement.

2. The method of claim 1, comprising removing from the ion trap the confined ions that remained in the ion trap after completing the ejecting by MSE.

3. The method of claim 1, wherein:

the ion trap comprises an entrance and an exit;

the injecting comprises applying an exit DC potential at the exit at a first exit DC potential magnitude to generate a DC potential barrier effective to prevent the ions of the injected ion pulse from exiting the ion trap at the exit;

the confining comprises applying an entrance DC potential at the entrance at a first entrance DC potential magnitude to generate a DC potential barrier effective to prevent the ions of the injected ion pulse from exiting the ion trap at the entrance and prevent other ions outside of the ion trap from entering the ion trap at the entrance, while maintaining the exit DC potential at the first exit DC potential magnitude; and the ejecting comprises switching the exit DC potential to a second exit DC potential magnitude lower than the first exit DC potential magnitude, to generate a partial DC potential barrier effective to allow the mass-selected ions to exit the ion trap through the exit by mass-selective ejection while preventing ions of non-selected masses of the confined ions from exiting the ion trap at the exit.

4. The method of claim 3, wherein the injecting comprises switching the entrance DC potential from the first entrance DC potential magnitude to a second entrance DC potential magnitude lower than the first entrance DC potential magnitude, wherein the second entrance DC potential magnitude is effective to allow the ion pulse to enter the ion trap through the entrance.

5. The method of claim 3, comprising removing residual ions of the confined ions that remained in the ion trap after completing the ejecting by MSE, by switching the exit DC potential to a third exit DC potential magnitude lower than the second exit DC potential magnitude, wherein the exit DC potential magnitude is effective to allow the residual ions to exit the ion trap through the exit.

6. The method of claim 1, comprising generating a radio-frequency (RF) electric field in the ion trap to limit radial excursions of the injected ions away from a central region or axis of the ion trap during the injecting, the confining and the ejecting.

7. The method of claim 6, wherein the ion trap comprises a plurality of guide electrodes defining a linear ion trap (LIT), and the generating the RF electric field comprises applying RF potentials to the guide electrodes.

8. The method of claim 7, comprising applying an axial DC potential gradient along the LIT to urge the injected ions in a direction toward the exit during the injecting, the confining and the ejecting.

9. The method of claim 8, wherein the LIT comprises an entrance and an exit respectively located at opposing axial ends of the ion guide electrodes, and the ejecting comprises axially ejecting the ions of selected masses through the exit.

10. The method of claim 6, wherein the ejecting comprises superimposing an auxiliary alternating-current (AC) electric field on the RF electric field, and scanning an operating parameter of at least one of the auxiliary AC electric field or the RF electric field to eject the ions of selected masses by resonant excitation.

11. The method of claim 10, wherein:

the ion trap comprises a plurality of guide electrodes defining a linear ion trap (LIT), and the generating the RF electric field comprises applying RF potentials to the guide electrodes; and the ejecting comprises applying the alternating-current (AC) potential to at least one opposing pair of the guide electrodes to generate the auxiliary AC electric field.

12. The method of claim 11, wherein the LIT comprises an entrance and an exit respectively located at opposing axial ends of the ion guide electrodes, and the ejecting comprises axially ejecting the ions of selected masses through the exit.

13. The method of claim 1, wherein the injecting comprises transmitting ions of the ion pulse from a quadrupole mass filter, and the transmitted ions are within a mass range set by the mass filter.

14. The method of claim 1, wherein the transmitting the ejected ions comprises transmitting the ejected ions through a quadrupole device positioned between the ion trap and the ion detector, and operating the quadrupole device as an RF-only ion guide or a mass filter.

15. The method of claim 14, wherein the operating the quadrupole device comprises scanning the quadrupole device at unit mass resolution in accordance with the mass-selective ejection, such that the ions of selected masses are ejected by the ion trap and filtered by the quadrupole device filter on the same mass-selective basis.

16. The method of claim 1, comprising at least one of:

flowing a buffer gas into the ion trap to kinetically cool the ions of the injected ion pulse during the injecting and the confining;

flowing a reaction gas into the ion trap and reacting the reaction gas with one or more of the injected ions during the confinement period, wherein the reacting is effective to suppress interfering ion signal intensity as measured by the ion detector.

17. The method of claim 1, comprising:

sequentially transmitting one or more additional ion pulses of the plurality of ion pulses to the ion trap; and repeating the steps of injecting, confining, ejecting, and transmitting to the ion detector for the one or more additional ion pulses.

18. An inductively coupled plasma-mass spectrometry (ICP-MS) system, comprising:

an ion source configured to receive successive single samples, generate plasma, and produce respective ion pulses in the plasma from the successive single samples;

an ion trap;

an ion detector; and a controller comprising an electronic processor and a memory, and configured to control an operation comprising:

producing the respective ion pulses in the ion source, wherein at least one of the respective ion pulses comprises a plurality of ions having two or more different masses;

injecting the at least one ion pulse into the ion trap;

after the injecting, confining the ions of the injected ion pulse in the ion trap during a confinement period, during which the confining prevents the confined ions from exiting the ion trap and prevents other ions outside of the ion trap from entering the ion trap;

after the confinement period, ejecting ions of selected masses of the confined ions mass-successively from the ion trap by mass-selective ejection; and transmitting the ejected ions mass-successively to the ion detector for measurement.

19. The ICP-MS system of claim 18, comprising at least one of:

a quadrupole ion guide positioned between the ion source and the ion trap, and configured to operate as an RF-only ion guide or as a mass filter;

a quadrupole ion guide positioned between the ion trap and the ion detector, and configured to operate as an RF-only ion guide or as a mass filter.

* * * * *